US011566366B2

(12) United States Patent
Jo et al.

(10) Patent No.: US 11,566,366 B2
(45) **Date of Patent: *Jan. 31, 2023**

(54) WASHING MACHINE

(71) Applicant: Samsung Electronics Co., Ltd., Suwon-si (KR)

(72) Inventors: Jae Hee Jo, Suwon-si (KR); Moon Jong Kim, Seoul (KR); Baek Gyu Kwon, Suwon-si (KR); Jong-Hun Sung, Suwon-si (KR); Seung-Mok Lee, Suwon-si (KR); Yong-Joon Jang, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 102 days.

This patent is subject to a terminal disclaimer.

(21) Appl. No.: 17/149,106

(22) Filed: Jan. 14, 2021

(65) Prior Publication Data

US 2021/0131019 A1 May 6, 2021

Related U.S. Application Data

(63) Continuation of application No. 15/850,771, filed on Dec. 21, 2017, now Pat. No. 10,914,030.

(30) Foreign Application Priority Data

Dec. 23, 2016 (KR) ..... 10-2016-0178568
Jun. 23, 2017 (KR) ..... 10-2017-0079658

(51) Int. Cl.
*D06F 39/08* (2006.01)
*D06F 21/02* (2006.01)
(Continued)

(52) U.S. Cl.
CPC ..... *D06F 39/088* (2013.01); *D06F 21/02* (2013.01); *D06F 21/06* (2013.01); *D06F 31/00* (2013.01); *D06F 29/00* (2013.01); *D06F 39/12* (2013.01)

(58) Field of Classification Search
CPC ..... D06F 21/02; D06F 21/06; D06F 39/088; D06F 31/00; D06F 39/12; D06F 29/00
See application file for complete search history.

(56) References Cited

U.S. PATENT DOCUMENTS 3,161,481 A * 12/1964 Edwards ..... D06F 43/02 34/527
RE25,784 E 5/1965 Robbins et al.
(Continued)

FOREIGN PATENT DOCUMENTS

CN 201487453 U 5/2010
DE 10046347 3/2002
(Continued)

OTHER PUBLICATIONS

Chinese Second Office Action dated Sep. 27, 2021 for Chinese Application No. 201780086515.X.
(Continued)

*Primary Examiner* — Benjamin L Osterhout
(74) *Attorney, Agent, or Firm* — Staas & Halsey LLP

(57) ABSTRACT

A washing machine comprises a first housing having a first laundry loading port, a first tub disposed in the first housing, a second housing having a second laundry loading port formed at a top portion and disposed on the first housing, a second tub disposed in the second housing, a water supply device connected to an external water source to supply wash water to the first tub and the second tub and installed at the second housing. The water supply device comprises a water supply connector having a plurality of chambers, a first water supply hose connecting the water supply connector
(Continued)

with the first tub, a second water supply hose connecting the water supply connector with the second tub, and a backflow prevention structure formed in one of the plurality of the chambers to operate by a pressure of wash water supplied to the plurality of chambers.

15 Claims, 19 Drawing Sheets

(51) Int. Cl.

| | |
|---|---|
| ***D06F 21/06*** | (2006.01) |
| ***D06F 31/00*** | (2006.01) |
| *D06F 29/00* | (2006.01) |
| *D06F 39/12* | (2006.01) |

(56) References Cited

U.S. PATENT DOCUMENTS

| | | | | |
|---|---|---|---|---|
| 10,914,030 | B2 * | 2/2021 | Jo | D06F 21/06 |
| 2011/0154865 | A1 * | 6/2011 | Lee | D06F 39/02 68/17 R |
| 2014/0096572 | A1 * | 4/2014 | Kim | D06F 39/12 68/17 R |
| 2014/0334957 | A1 | 11/2014 | Simmons et al. | |
| 2016/0289884 | A1 | 10/2016 | Kim et al. | |

FOREIGN PATENT DOCUMENTS

| | | |
|---|---|---|
| EP | 2949807 | 12/2015 |
| KR | 20-1998-013163 | 6/1998 |
| KR | 10-2007-0028012 | 3/2007 |
| KR | 10-1306723 | 9/2013 |
| KR | 10-2015-0072169 | 6/2015 |

OTHER PUBLICATIONS

International Search Report dated Apr. 10, 2018, in corresponding International Patent Application No. PCT/KR2017/014618, 3 pgs.
Extended European Search Report dated Sep. 10, 2019 in European Patent Application No. 17882424.9.
U.S. Office Action dated Sep. 20, 2019 in U.S. Appl. No. 15/850,771.
U.S. Office Action dated Jan. 9, 2020 in U.S. Appl. No. 15/850,771.
U.S. Office Action dated Jul. 10, 2020 in U.S. Appl. No. 15/850,771.
U.S. Notice of Allowance dated Oct. 6, 2020 in U.S. Appl. No. 15/850,771.
U.S. Appl. No. 15/850,771, filed Dec. 21, 2017, Jae Hee Jo, et al., Samsung Electronics Co., Ltd.
European Search Report dated Dec. 7, 2021 for European Application No. 17 882 424.9.
Chinese Office Action dated Jan. 4, 2021 in Chinese Patent Application No. 201780086515.X.
Office Action dated Apr. 18, 2021 issued in Chinese Application No. 201780086515.X.
Office Action dated May 19, 2022 issued in Korean Application No. 10-2017-0079658.

* cited by examiner

WASHING MACHINE

CROSS-REFERENCE TO RELATED APPLICATION(S)

This application is a continuation application of U.S. patent application Ser. No. 15/850,771 filed Dec. 21, 2017, which claims the benefit of Korean Patent Application Nos. 10-2016-0178568 filed on Dec. 23, 2016 and 10-2017-0079658 filed on Jun. 23, 2017 in the Korean Intellectual Property Office, the disclosures of which are incorporated herein by reference.

BACKGROUND

1. Field

Embodiments of the present disclosure relate to a washing machine, and more particularly, to a washing machine having a plurality of washing spaces.

2. Description of the Related Art

In general, a washing machine is an apparatus used to wash laundry by rotating a cylindrical drum in which the laundry is contained. Washing machines are classified into washing machines in which a drum is approximately horizontally disposed and laundry is washed while being lifted along an inner wall and dropped during rotation of the drum about a horizontal axis and washing machines in which a drum provided with a pulsator is approximately vertically disposed and laundry is washed by using water streams generated by the pulsator while the drum rotates about a vertical axis.

The washing machines in which the drum is horizontally disposed are referred to as front-loading washing machines since a laundry loading port is formed at a front surface of the washing machines. The washing machines in which the drum is vertically disposed are referred to as top-loading washing machines since a laundry loading port is formed at an upper surface of the washing machines.

Meanwhile, since a conventional washing machine includes one washing space, a user needs to operate the washing machine at least twice in order to separately wash laundry. As a result, even a relatively small amount of laundry takes a long time to be washed and thus a waste of energy cannot be avoided.

SUMMARY

Therefore, it is an aspect of the present disclosure to provide a washing machine including a water supply device that supplies water to a plurality of washing spaces.

It is another aspect of the present disclosure to provide a washing machine having a structure that supplies at least one of hot water and cold water to each of the plurality of washing spaces.

It is another aspect of the present disclosure to provide a washing machine having a simple structure of a water supply channel to each of the plurality of washing spaces.

It is another aspect of the present disclosure to provide a washing machine having a structure that prevents a backflow of water supplied to a water supply device.

Additional aspects of the disclosure will be set forth in part in the description which follows and, in part, will be obvious from the description, or may be learned by practice of the disclosure.

In accordance with one aspect of the present disclosure, a washing machine may include a first housing having a first laundry loading port formed at a front portion, a first tub disposed in the first housing, a second housing having a second laundry loading port formed at a top portion of the second housing, and the second housing disposed on the first housing, a second tub disposed in the second housing, a water supply device connectable to an external water source to supply water to the first tub and the second tub, the water supply device being installable to the second housing. The water supply device may include a water supply connector having a plurality of chambers formed therein, a first water supply hose connecting the water supply connector with the first tub and a second water supply hose connecting the water supply connector with the second tub.

The plurality of chambers may include a first chamber and a second chamber formed outside the first chamber along an outer periphery of the first chamber. The first chamber and the second chamber may be separated from each other by a partition wall.

The water supply connector may include a first hot water inflow nozzle configured to supply hot water to the first chamber and a first cold water inflow nozzle configured to supply cold water to the first chamber.

The first hot water inflow nozzle and the first cold water inflow nozzle may respectively protrude from a first wall of the water supply connector to be spaced apart from each other.

The water supply connector may further include a first discharge nozzle protruding from a second wall of the water supply connector facing the first wall to discharge water out of the first chamber.

The water supply connector may further include a connection flow path connecting the first chamber with the first discharge nozzle. The connection flow path may be formed across at least a portion of the second chamber, and the connection flow path does not to communicate with the second chamber.

The water supply connector may include a second hot water inflow nozzle configured to supply hot water to the second chamber and a second cold water inflow nozzle configured to supply cold water to the second chamber.

The second hot water inflow nozzle and the second cold water inflow nozzle may respectively protrude from the first wall of the water supply connector to be spaced apart from each other.

The water supply connector may further include a second discharge nozzle protruding from the second wall of the water supply connector facing the first wall to discharge water out of the second chamber.

In accordance with one aspect of the present disclosure, the washing machine may further include a water supply valve disposed between the external water source and the water supply connector to control the supply of water.

In accordance with one aspect of the present disclosure, the washing machine may further include a detergent case installed at the second housing to retain a detergent to be supplied to the first tub. The first water supply hose may include a first hose connecting the water supply connector with the detergent case and a second hose connecting the detergent case with the first tub.

In accordance with another aspect of the present disclosure, a washing machine may include a first housing, a first tub disposed in the first housing, a second housing disposed on the first housing, a second tub disposed in the second housing and a water supply device connectable to an external water source to supply water to the first tub and the second tub, the water supply device being installable at the second housing. The water supply device may include a water supply connector having a plurality of chambers separated from each other.

The first housing may have a first laundry loading port formed at a front portion. The second housing may have a second laundry loading port formed at a top portion.

In accordance with another aspect of the present disclosure, the washing machine may further include a first water supply channel connecting the external water source with the first tub and a second water supply channel connecting the external water source with the second tub. The plurality of chambers may include a first chamber disposed in the first water supply channel and a second chamber disposed in the second water supply channel.

The water supply connector may further include a first partition wall separating the first chamber and the second chamber from each other and the first partition wall has a first communication hole communicating with one of the first water supply channel and the second water supply channel.

The second chamber may be formed outside the first chamber along an outer periphery of the first chamber.

In accordance with another aspect of the present disclosure, the washing machine may further include a third water supply channel connecting the external water source with a spray nozzle installed at the first tub and the third water supply channel does not to communicate with the first water supply channel and the second water supply channel.

The plurality of chambers may further include a third chamber disposed in the third water supply channel.

The water supply connector may include a backflow prevention structure formed in the plurality of chambers to operate by a pressure of water supplied to the plurality of chambers.

The water supply connector may further include a plurality of hot water inflow nozzles configured to supply hot water to the plurality of chambers and a plurality of cold water inflow nozzles configured to supply cold water to the plurality of chambers. While water is supplied through one of the plurality of hot water inflow nozzles and the plurality of cold water inflow nozzles, the backflow prevention structure may prevent a backflow of the water into another nozzle of the plurality of hot water inflow nozzles and the plurality of cold water inflow nozzles.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
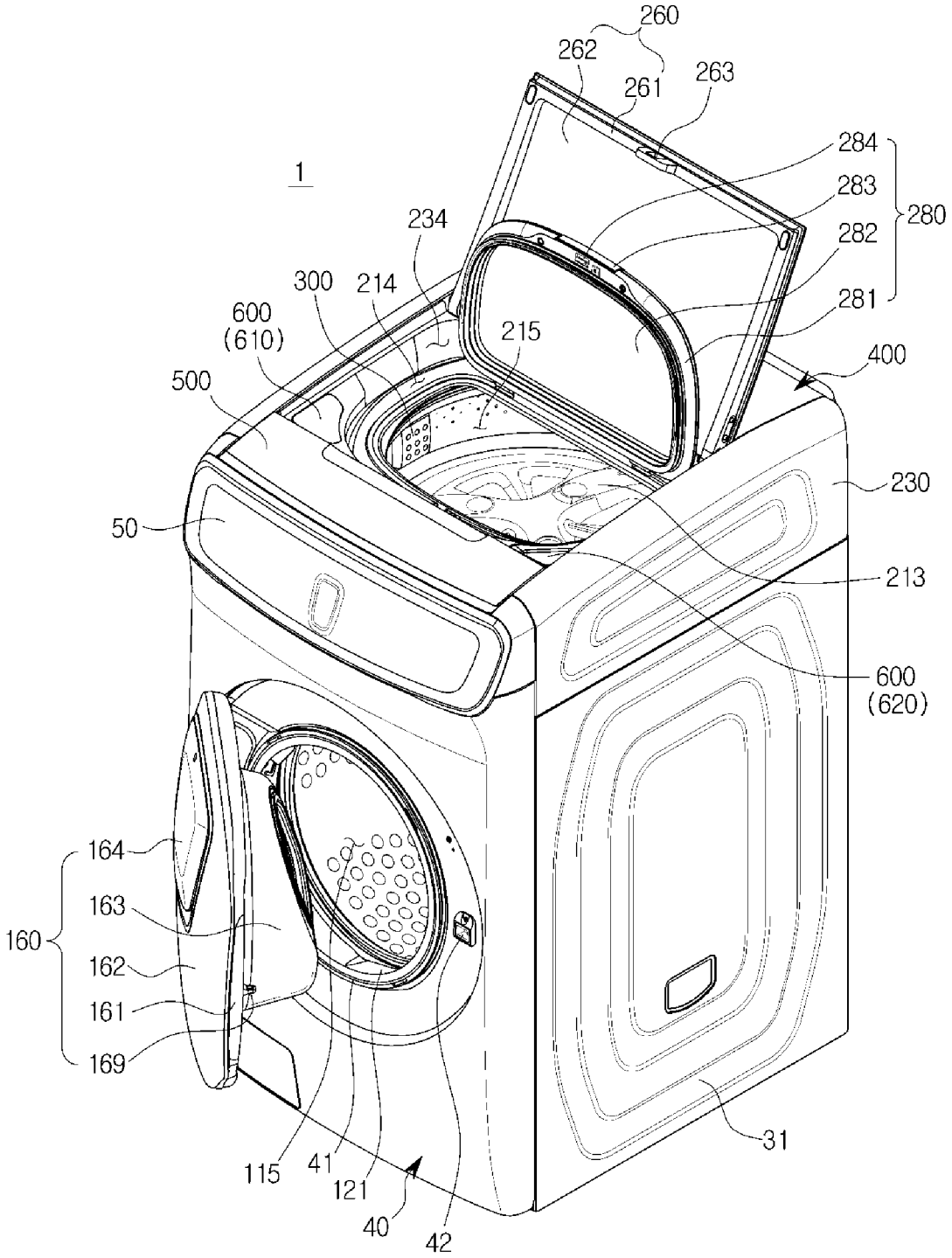
FIG. 1 is a perspective view illustrating a washing machine according to an embodiment of the present disclosure.

Reference will now be made in detail to the embodiments of the present disclosure, examples of which are illustrated in the accompanying drawings. The embodiments described in the specification and shown in the drawings are only illustrative and are not intended to represent all aspects of the invention, such that various modifications may be made without departing from the spirit of the invention.

In the drawings, like reference numerals denote like elements or components having substantially same functions.

The terms used in the present specification are merely used to describe particular embodiments, and are not intended to limit the present disclosure. An expression used in the singular encompasses the expression of the plural, unless it has a clearly different meaning in the context. In the present specification, it is to be understood that the terms such as "including" or "having", etc., are intended to indicate the existence of the features, numbers, operations, components, parts, or combinations thereof disclosed in the specification, and are not intended to preclude the possibility that one or more other features, numbers, operations, components, parts, or combinations thereof may exist or may be added.

It will be understood that, although the terms "first", "second", etc., may be used herein to describe various elements, these elements should not be limited by these terms. The above terms are used only to distinguish one component from another. For example, a first component discussed below could be termed a second component, and similarly, the second component may be termed the first component without departing from the teachings of this disclosure. As used herein, the term "and/or" includes any and all combinations of one or more of the associated listed items.

Hereinafter, embodiments of the present disclosure will be described in detail with reference to the accompanying drawings.

Figure 2:
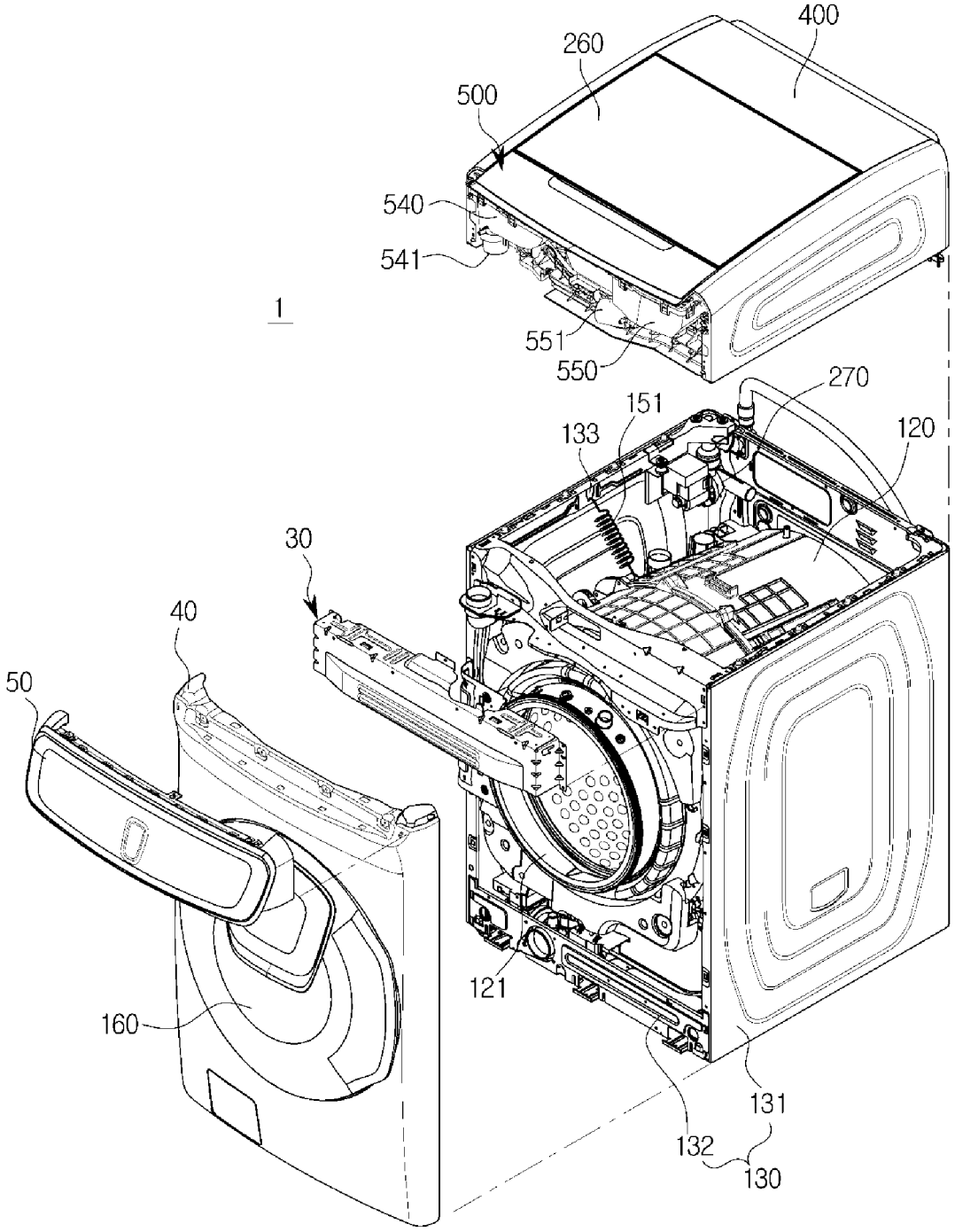
FIG. 2 is a view of the washing machine in which a first module and a second module are separated.
Figure 3:
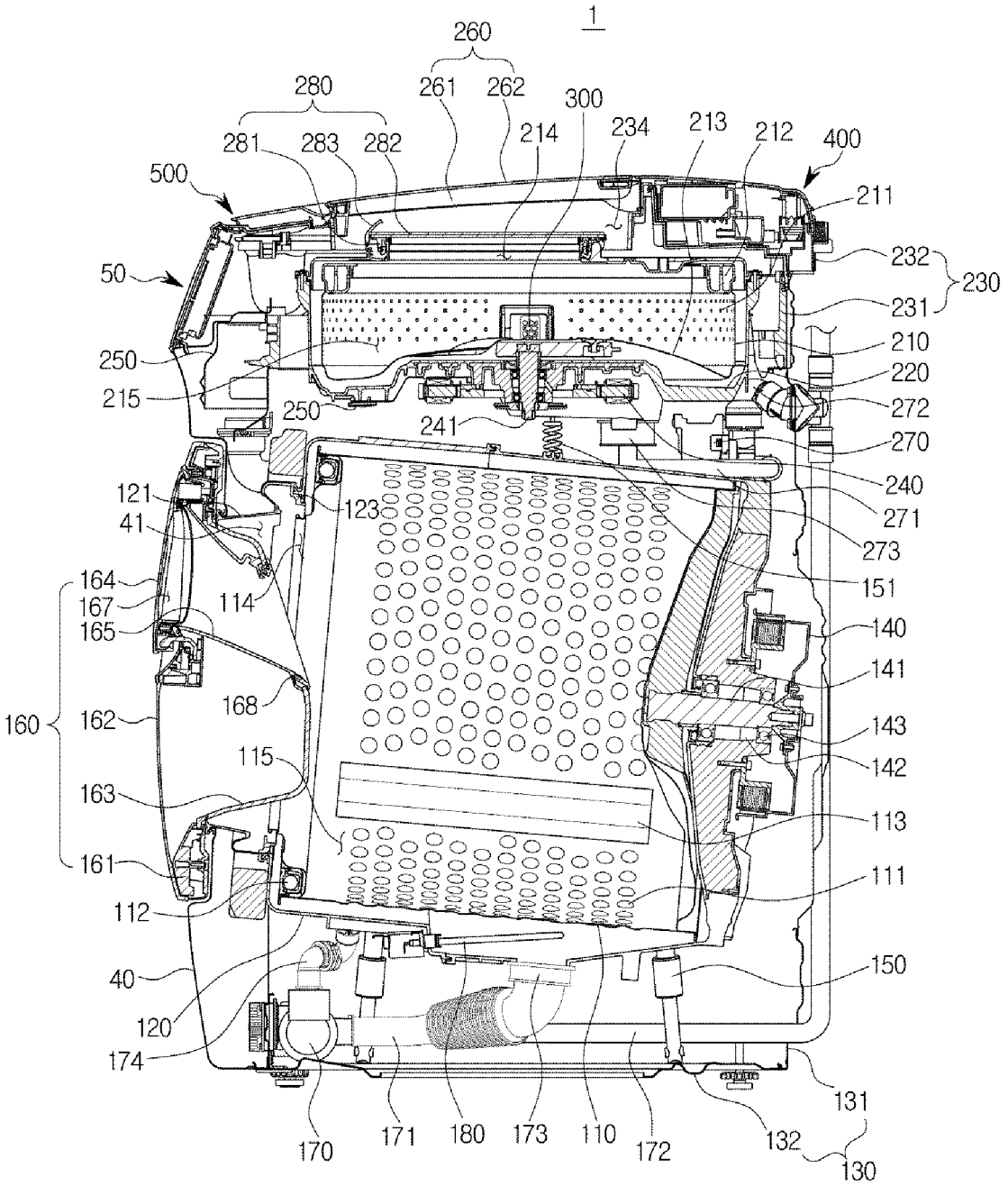
FIG. 3 is a cross-sectional view of the washing machine.

FIG. 1 is a perspective view illustrating a washing machine according to an embodiment of the present disclosure. FIG. 2 is a view of the washing machine in which a first module and a second module are separated. FIG. 3 is a cross-sectional view of the washing machine.

As illustrated in FIGS. 1 to 3, a washing machine 1 may include a front-loading type first washing apparatus having a first laundry loading port 41 formed at a front portion and a top-loading type second washing apparatus having a second laundry loading port 234 formed at a top portion.

The washing machine 1 may include a first drum 110 having a first washing space 115 therein.

The washing machine 1 may further include a first tub 120 that accommodates the first drum 110 and retains wash water or rinse water used in a washing cycle or a rinsing cycle.

The first drum 110 and the first tub 120 may have a cylindrical shape with at least a portion of one surface being open which faces forward.

The washing machine 1 may further include a first housing 130 in which the first drum 110 and the first tub 120 are disposed. Specifically, the first housing 130 may include a side frame 131 defining side and rear appearances and a bottom frame 132 defining a bottom surface.

The washing machine 1 may further include a spring 151 and a damper 150 to support the first tub 120 with respect to the first housing 130. The damper 150 may support the first tub 120 under the first tub 120 by connecting an outer surface of the first tub 120 with the bottom frame 132. The spring 151 may support the first tub 120 on an upper portion of the first tub 120 by connecting the outer surface of the first tub 120 with a spring coupling unit 133 provided at an upper portion of the side frame 131. The spring 151 and the damper 150 may relieve vibration, noise, and impact caused by movement of the first tub 120.

Installation positions of the spring 151 and the damper 150 are not limited to the upper end of the side frame 131 and the bottom frame 132. If required, the first tub 120 may be supported thereby by connecting one surface of the first tub 120 with one portion of the first housing 130.

The washing machine 1 may further include a first drive motor 140 disposed behind the first tub 120 and configured to rotate the first drum 110. A first drive shaft 141 may be connected to a rear surface of the first drum 110 to transmit power of the first drive motor 140 thereto.

A plurality of first through holes 111 may be formed through a peripheral wall of the first drum 110 to allow a flow of wash water therethrough. A plurality of lifters 113 may be installed on an inner surface of the peripheral wall of the first drum 110 for tumbling of laundry during rotation of the first drum 110. A first balancer 112 may be provided at a front portion of the first drum 110 for stable rotation of the first drum 110 during high-speed rotation.

The first drive shaft 141 may be disposed between the first drum 110 and the first drive motor 140. One end of the first drive shaft 141 may be connected to a rear plate of the first drum 110 and the other end of the first drive shaft 141 may extend outwardly from a rear wall of the first tub 120. When the first drive motor 140 drives the first drive shaft 141, the first drum 110 connected to the first drive shaft 141 may rotate about the first drive shaft 141.

A bearing housing 142 may be disposed at the rear wall of the first tub 120 to allow rotation of the first drive shaft 141. The bearing housing 142 may be formed of an aluminum alloy and inserted into the rear wall of the first tub 120 during injection molding of the first tub 120. Bearings 143 may be provided between the bearing housing 142 and the first drive shaft 141 for smooth rotation of the first drive shaft 141.

The washing machine 1 may have a function of washing the laundry with hot water. In order to obtain hot water, a heater 180 that heats wash water or rinse water contained in the first tub 120 may be provided at the bottom of the first tub 120.

The washing machine 1 may include a first drain pump 170 disposed under the first tub 120 and configured to drain water contained in the first tub 120 out of the washing machine 1, a first connection hose 171 connecting a first drain hole 173 and the first drain pump 170 to allow water contained in the first tub 120 to flow into the first drain pump 170, a circulation hose 174 connecting the first drain pump 170 and the first tub 120 to circulate water introduced into the first drain pump 170 to the first tub 120, and a first drain hose 172 configured to guide water pumped by the first drain pump 170 out of the washing machine 1.

The washing machine 1 may further include a front cover 40 having the first laundry loading port 41 through which laundry is loaded into the first washing space 115. A first door 160 configured to open and close the first laundry loading port 41 may be coupled to the front cover 40.

The first door 160 may be formed so as to correspond to the first laundry loading port 41 and be pivotally rotatable about the front cover 40. The first door 160 may include a first door frame 161, a first door cover 162, and a door glass 163.

Although the first door frame 161 is formed in an approximately annular shape according to the present embodiment, the shape of the first door frame 161 may be approximately rectangular. The first door cover 162 and the door glass 163 may be formed of a transparent material such that the inside of the first drum 110 is visible from the outside of the washing machine 1 even when the first door 160 closes the first laundry loading port 41. The door glass 163 may be disposed to protrude from the first door frame 161 toward the inside of the first drum 110. According to this configuration, when the first door 160 is closed, the door glass 163 may be inserted into the first laundry loading port 41.

A first hinge may be provided around the first laundry loading port 41 to allow the first door 160 to pivotally rotate about the front cover 40 and the first hinge is coupled to a first hinge coupling portion formed at one side of the first door frame 161. A first hook 166 may be provided at the other side of the first door frame 161 and the front cover 40 may have a first hook receiving portion 42 corresponding to the first hook 166. The first laundry loading port 41 may be maintained in a state of being closed by the first door 160 by coupling of the first hook 166 with the first hook receiving portion 42.

The first door 160 may further include an auxiliary laundry loading port 167 and an auxiliary door 164 configured to open and close the auxiliary laundry loading port 167 such that laundry is loaded into the first washing space 115 even when the first door 160 is closed. The auxiliary door 164 may be pivotally rotatably mounted to the first door cover 162.

In order to load laundry into the washing machine 1 through the auxiliary laundry loading port 167 of the first door 160, the laundry should pass through the door glass 163. To this end, the door glass 163 may have a glass through hole 168. Alternatively, an upper portion of the door glass 163 may be recessed such that the door glass 163 is not disposed behind the auxiliary laundry loading port 167.

The first door 160 may have a connection guide part 165 to connect the auxiliary laundry loading port 167 of the first door 160 and the glass through hole 168 of the door glass 163. The connection guide part 165 may be formed in a hollow tubular shape having both open ends.

Specifically, one end of the connection guide part 165 may be connected to the auxiliary laundry loading port 167 and the other end may be connected to the glass through hole 168. According to the present embodiment, the connection guide part 165 may be inclined downward from the front to the rear. That is, the one end of the connection guide part 165 connected to the auxiliary laundry loading port 167 may be positioned higher than the other end thereof. According to this configuration, a user may easily load the laundry into the first drum 110 through the auxiliary laundry loading port 167.

Although the first door 160 includes the auxiliary door 164 according to the present embodiment, the present disclosure is not limited thereto and the first door 160 may be configured without having the auxiliary laundry loading port, the auxiliary door, and the connection guide part.

The washing machine 1 may include a diaphragm 121 disposed between the first laundry loading port 41 of the front cover 40 and a first opening 123 of the first tub 120. The diaphragm 121 may form a passage from the first laundry loading port 41 to an opening 114 of the first drum 110 and decrease vibration transmitted to the front cover 40 during rotation of the first drum 110. Also, one portion of the diaphragm 121 may be disposed between the first door 160 and the front cover 40 to prevent leakage of wash water contained in the first tub 120 out of the washing machine 1.

The washing machine 1 may further include a second drum 210 having a second washing space 215.

The washing machine 1 may further include a second tub 220 that accommodates the second drum 210 and retains wash water or rinse water used in a washing cycle or a rinsing cycle.

The second drum 210 and the second tub 220 may have a cylindrical shape with at least a portion of one surface being open which faces upward.

The washing machine 1 may further include a second housing 230 in which the second drum 210 and the second tub 220 are disposed. Specifically, the second housing 230 may include a lower frame 231 configured to support the second tub 220 and an upper frame 232 having a second laundry loading port 234 through which laundry is loaded into the second washing space 215 and seated on the lower frame 231. The second housing 230 may further include a side cover 233 defining left and right side appearances of the second housing 230.

The washing machine 1 may include a second door 260 disposed at the second housing 230 and configured to open and close the second laundry loading port 234. The second door 260 may be formed so as to correspond to the second laundry loading port 234 and be pivotally rotatable with respect to the upper frame 232. The second door 260 may include a second door frame 261 and a second door cover 262. The second door cover 262 may be formed of a transparent material such that the inside of the second tub 220 and the second drum 210 is visible from the outside of the washing machine 1 even when the second door 260 closes the second laundry loading port 234.

Second hinges may be provided at the left and right sides of the second door frame 261 to allow the second door 260 to pivotally rotate about the upper frame 232 and the second hinges are coupled to a second hinge coupling portion formed around the second laundry loading port 234. Since a latch receiving part 263 may be provided at the front portion of the second door frame 261 and a latch unit may be provided at the upper frame 232 to correspond to the latch receiving part 263 of the second door frame 261, the second laundry loading port 234 is not accidently opened during a washing cycle.

The second drum 210 may be provided in a cylindrical shape having an open top surface and rotatable within the second tub 220. A plurality of through holes 211 may be formed through a side surface and/or a bottom surface of the second drum 210 to allow a flow of wash water therethrough. A second balancer 212 may be mounted at an upper portion of the second drum 210 for stable rotation of the second drum 210 during high-speed rotation. A filter 300 may be attached to the inner side surface of the second drum 210 so as to remove foreign substances during washing.

A curved portion 213 to generate water streams may be formed on the bottom surface of the second drum 210. Although not shown in the drawings, the washing machine 1 may further include a pulsator disposed in the second drum 210 to generate water streams.

The second tub 220 may have a cylindrical shape and be supported by the lower frame 231 using a suspension 250. Specifically, the second tub 220 may be supported in the form of being hung at the lower frame 231 by four suspensions 250. The second drum 220 may have a third laundry loading port 214 at a top surface thereof to correspond to the second laundry loading port 234 and a third door 280 may be coupled thereto to open and close the third laundry loading port 214.

The third door 280 may include a third door frame 281 and a third door cover 282. The third door cover 282 may be formed of a transparent material such that the inside of the second drum 210 is visible from the outside of the second tub 220 even when the third door 280 closes the third laundry loading port 214.

A third hinge may be provided around the third laundry loading port 214 such that the third door 280 pivotally rotates about the second tub 220 and coupled to a third hinge coupling portion formed at one side of the third door frame 281. A handle 283 to open and close the third door 280 may be provided at the other side of the third door frame 281 and a second hook 284 may be provided at the handle 283. A second hook receiving part may be disposed at the second tub 220 to correspond to the second hook 284, so that the third door 280 may be maintained in a state of closing the third laundry loading port 214. When the handle 283 is pulled, the second hook 284 is disengaged from the second hook receiving part to open the third door 280.

The washing machine 1 may further include a second drive motor 240 disposed under an outer surface of the second tub 220 and configured to rotate the second drum 210. A second drive shaft 241 may be connected to a bottom plate of the second drum 210 to transmit power of the second drive motor 240 thereto. One end of the second drive shaft 241 may be connected to the bottom plate of the second drum 210 and the other end of the second drive shaft 241 may extend outwardly from a bottom wall of the second tub 220. When the second drive motor 240 drives the second drive shaft 241, the second drum 210 connected to the second drive shaft 241 may rotate about the second drive shaft 241.

Although not shown in the drawings, when the pulsator is disposed on the bottom surface of the second drum 210, the washing machine 1 may further include a power switching device to transmit power generated by the second drive motor 240 to the second drum 210 and the pulsator simultaneously or selectively.

The washing machine 1 may include a second drain pump 270 disposed under the second tub 220 and configured to drain water contained in the second tub 220 out of the washing machine 1 and a second drain hose 272 configured to guide the water pumped by the second drain pump 270 out of the washing machine 1. Specifically, the second drain pump 270 may be mounted to an upper portion of the first housing 130.

A second drain hole 273 to drain water from the second tub 220 may be disposed at the bottom surface of the second tub 220 and the second drain hole 273 may be connected to the second drain pump 270 via a second connection hose 271 to allow water contained in the second tub 220 to flow into the second drain pump 270.

The washing machine 1 may further include a water supply device 400 to supply wash water to the first tub 120 and the second tub 220. The water supply device 400 may be disposed at the second housing 230. The water supply device 400 will be described in more detail below.

The washing machine 1 may further include a first detergent supply device 500 to supply a detergent to the first tub 120. The first detergent supply device 500 may be disposed at the second housing 230. Specifically, the first detergent supply device 500 may be disposed at the upper frame 232, preferably in front of the second laundry loading port 234.

The washing machine 1 may further include a second detergent supply device 600 to retain a fabric softener and/or a bleach to be fed into the second washing space 215. The second detergent supply device 600 may be provided to allow the user to access thereto by opening the second door 260. The second detergent supply device 600 may be disposed at the upper frame 232. The second detergent supply device 600 may be disposed at left and right end portions in front of the third laundry loading port 214 respectively. That is, the second detergent supply device 600 may include a first detergent case 610 disposed at a left end portion in front of the third laundry loading port 214 and a second detergent case 620 disposed at a right end portion in front of the third laundry loading port 214. Preferably, the bleach may be retained in the first detergent case 610 and the fabric softener may be retained in the second detergent case 620. A laundry detergent may directly be introduced into the second washing space 215 through the third laundry loading port 214 by the user.

The washing machine 1 may further include a fixing bracket 30 to fixedly couple the first housing 130 with the second housing 230.

The washing machine 1 may further include a control panel 50 disposed on the front cover 40 to operate the washing machine 1. The control panel 50 may include an input unit to receive a command to operate the washing machine 1 from the user and a display unit to display operation information of the washing machine 1.

Figure 4:
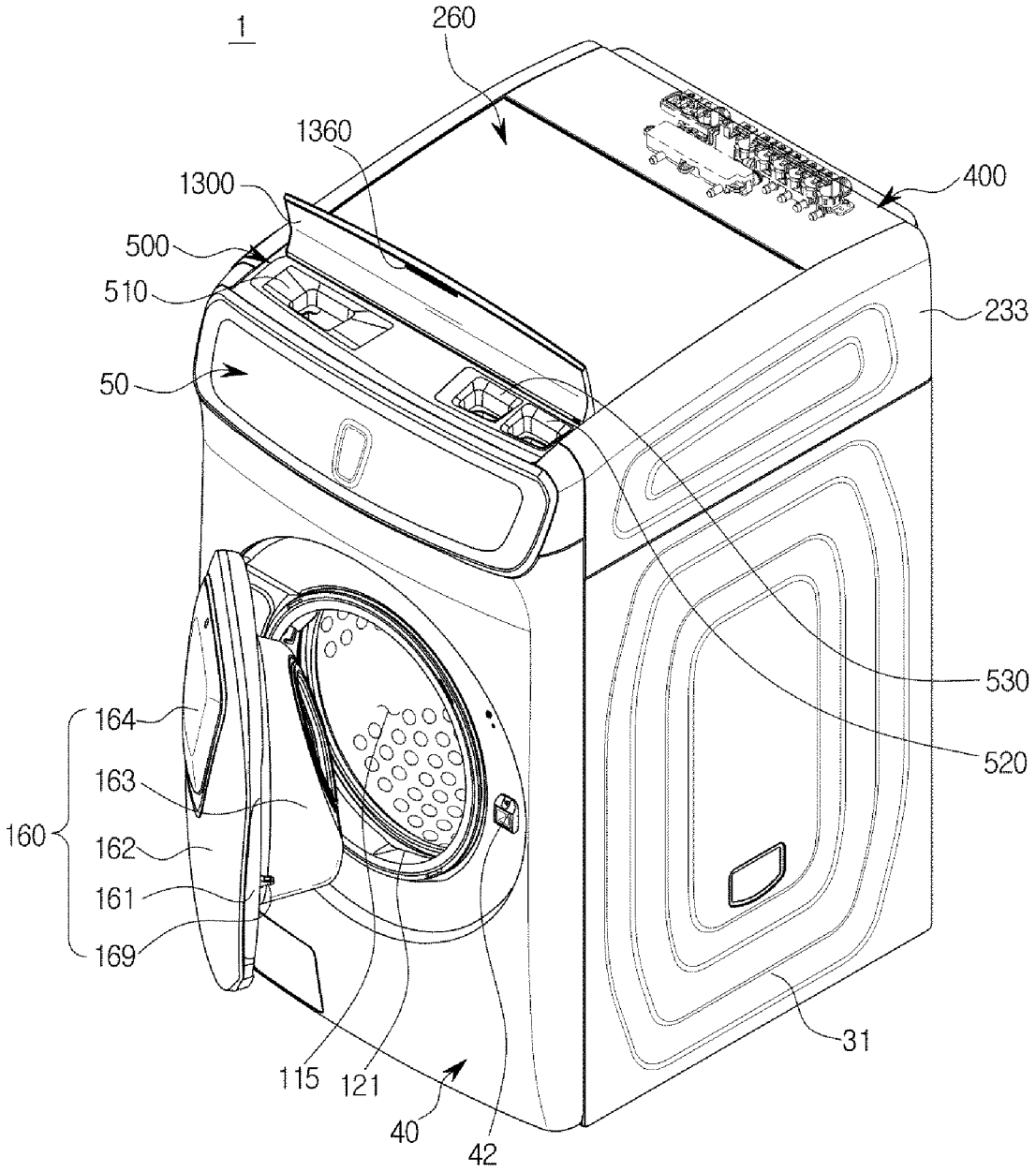
FIG. 4 is a view illustrating a washing machine according to an embodiment in which a storage cover of a first detergent supply device is open.
Figure 5:
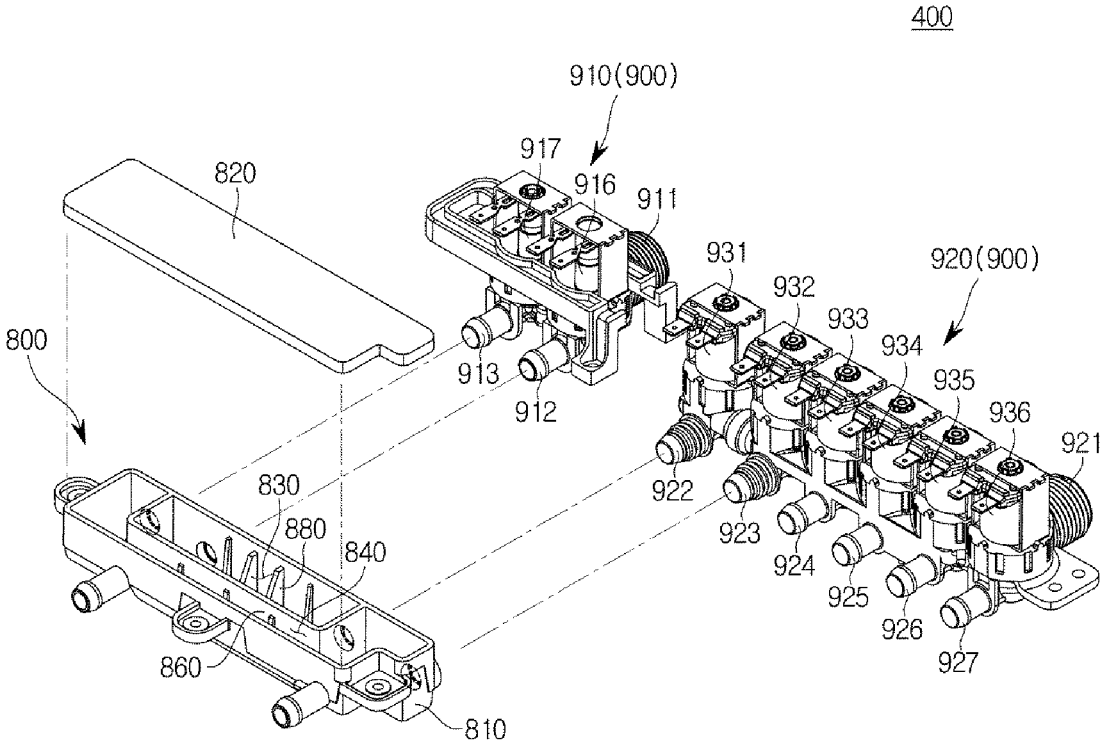
FIG. 5 is a view illustrating a water supply device of the washing machine.

FIG. 4 is a view illustrating a washing machine according to an embodiment in which a storage cover of a first detergent supply device is open. FIG. 5 is a view illustrating a water supply device of the washing machine. Hereinafter, a case where a water supply connector 800 according to a first exemplary embodiment is applied will be described as an example. Hereinafter, descriptions of reference numerals not described herein will be given later with reference to FIG. 9.

As illustrated in FIGS. 4 and 5, the first detergent supply device 500 may include a plurality of detergent cases 510, 520, and 530 that store detergents to be fed into the first washing space 115 and are disposed at the second housing 230. In this regard, the detergent may include a laundry detergent, a fabric softener, and a bleach.

The plurality of detergent cases 510, 520, and 530 may include a first detergent case 510 disposed at one lateral end of the second housing 230. The plurality of detergent cases 510, 520, and 530 may further include a second detergent case 520 disposed at the other lateral end of the second housing 230. Particularly, the first detergent case 510 may be disposed at the left end in front of the second laundry loading port 234 and the second detergent case 520 may be disposed at the right end in front of the second laundry loading port 234. Preferably, the first detergent case 510 may store the laundry detergent and the second detergent case 520 may store the bleach.

The plurality of detergent cases 510, 520, and 530 may further include a third detergent case 530 disposed between the first detergent case 510 and the second detergent case 520. Specifically, the third detergent case 530 may be disposed to be adjacent to the second detergent case 520 between the first detergent case 510 and the second detergent case 520 in a lateral direction of the second housing 230. The third detergent case 530 may store a detergent different from those stored in the first detergent case 510 and the second detergent case 520. Preferably, the second detergent case 520 may store a fabric softener.

The water supply device 400 may be connected to an external water source 700 (FIG. 6) to supply wash water to the first tub 120 and the second tub 220. The external water source 700 may include a hot water source 710 (FIG. 6) that supplies hot water and a cold water source 720 (FIG. 6) that supplies cold water. The water supply device 400 may be installed at the second housing 230. Specifically, the water supply device 400 may be disposed at the upper frame 232, preferably, behind the second laundry loading port 234.

The water supply device 400 may include the water supply connector 800. The water supply connector 800 may include a connector housing 810 and a connector cover 820 defining an appearance of the water supply connector 800 together with the connector housing 810. The water supply connector 800 may further include a plurality of chambers 830 and 840 formed therein. Specifically, the plurality of chambers 830 and 840 may be formed in the connector housing 810. The water supply connector 800 may further include a partition wall separating the plurality of chambers 830 and 840 from each other. The partition wall 860 may extend from the connector housing 810 to have a predetermined height. The water supply connector 800 may further include a rigidity reinforcing rib 880 formed at the connector housing 810 to reinforce rigidity. The water supply connector 800 may be implemented in various forms and detailed descriptions of the water supply connector 800 in various forms will be given later.

The water supply device 400 may further include a water supply valve 900. The water supply valve 900 may be disposed between the external water source 700 and the water supply connector 800 to control the supply of wash water.

The water supply valve 900 may include a first valve unit 910 disposed between the hot water source 710 and the water supply connector 800. The first valve unit 910 may be connected to the water supply connector 800 and the hot water source 710. Particularly, the first valve unit 910 may include a water source coupler 911 connected to the hot water source 710 and a connector coupler connected to the water supply connector 800. More particularly, the first valve unit 910 may include one water source coupler 911 connected to the hot water source 710 and a plurality of connector couplers respectively connected to the plurality of chambers 830 and 840. The water source coupler 911 may be disposed to face an opposite direction to the plurality of connector couplers. The first valve unit 910 may further include a plurality of valve channels connecting the water source coupler 911 with each of the plurality of connector couplers. The first valve unit 910 may further include a plurality of valves disposed adjacent to the plurality of connector couples, respectively, to control the supply of hot water. The number of the valves may be the same as that of the connector couplers.

The water supply valve 900 may further include a second valve unit 920 disposed between the cold water source 720 and the water supply connector 800. The second valve unit 920 may be connected to the cold water source 720. Particularly, the second valve unit 920 may further include a water source coupler 921 connected to the cold water source 720. More particularly, the second valve unit 920 may include one water source coupler 921 connected to the cold water source 720. A part of the second valve unit 920 may be connected to the water supply connector 800. More particularly, a part of the second valve unit 920 adjacent to the water supply connector 800 may be connected to the water supply connector 800. The second valve unit 920 may further include a connector coupler connected to the water supply connector 800. Specifically, the second valve unit 920 may include a plurality of connector couplers respectively connected to the plurality of chambers 830 and 840. The other part of the second valve unit 920 may be connected to elements requiring the supply of cold water. The elements requiring the supply of cold water will be described later. The second valve unit 920 may further include a plurality of couplers connected to the elements requiring the supply of cold water. The plurality of connector couplers and the plurality of couplers may be disposed to face the same direction. The water source coupler 921 may be disposed to face an opposite direction of the plurality of connector couplers and the plurality of connectors. The second valve unit 920 may further include a plurality of valve channels connecting the water source coupler 921 with the plurality of connector couplers and connecting the water source coupler 921 with the plurality of couplers to allow cold water to flow therethrough. The second valve unit 920 may further include a plurality of valves disposed adjacent to the plurality of connector couplers and the plurality of couplers, respectively, to control the supply of cold water. The number of valves may be the same as a sum of the number of the connector couplers and the number of the couplers.

The washing machine 1 may further include a storage cover 1300 provided to cover the plurality of detergent cases 510, 520, and 530 and a rotating shaft member (not shown) that rotatably supports the storage cover 1300. The storage cover 1300 may be pivotally rotatably coupled to the upper frame 232. The storage cover 1300 may be disposed at a portion where the plurality of detergent cases 510, 520, and 530 are located in front of the second laundry loading port 234.

The storage cover 1300 may include a buffer member 1360 disposed under a front end portion of the storage cover 1300. The buffer member 1360 may be formed of an elastic material. The buffer member 1360 may be disposed on the bottom surface of the storage cover 1300 at one side opposite to the rotating shaft member. The buffer member 1360 may relieve the impact that may be caused by a collision between the front end portion of the storage cover 1300 and the upper frame 232 when the storage cover 1300 closes the plurality of detergent cases 510, 520, and 530.

Figure 6:
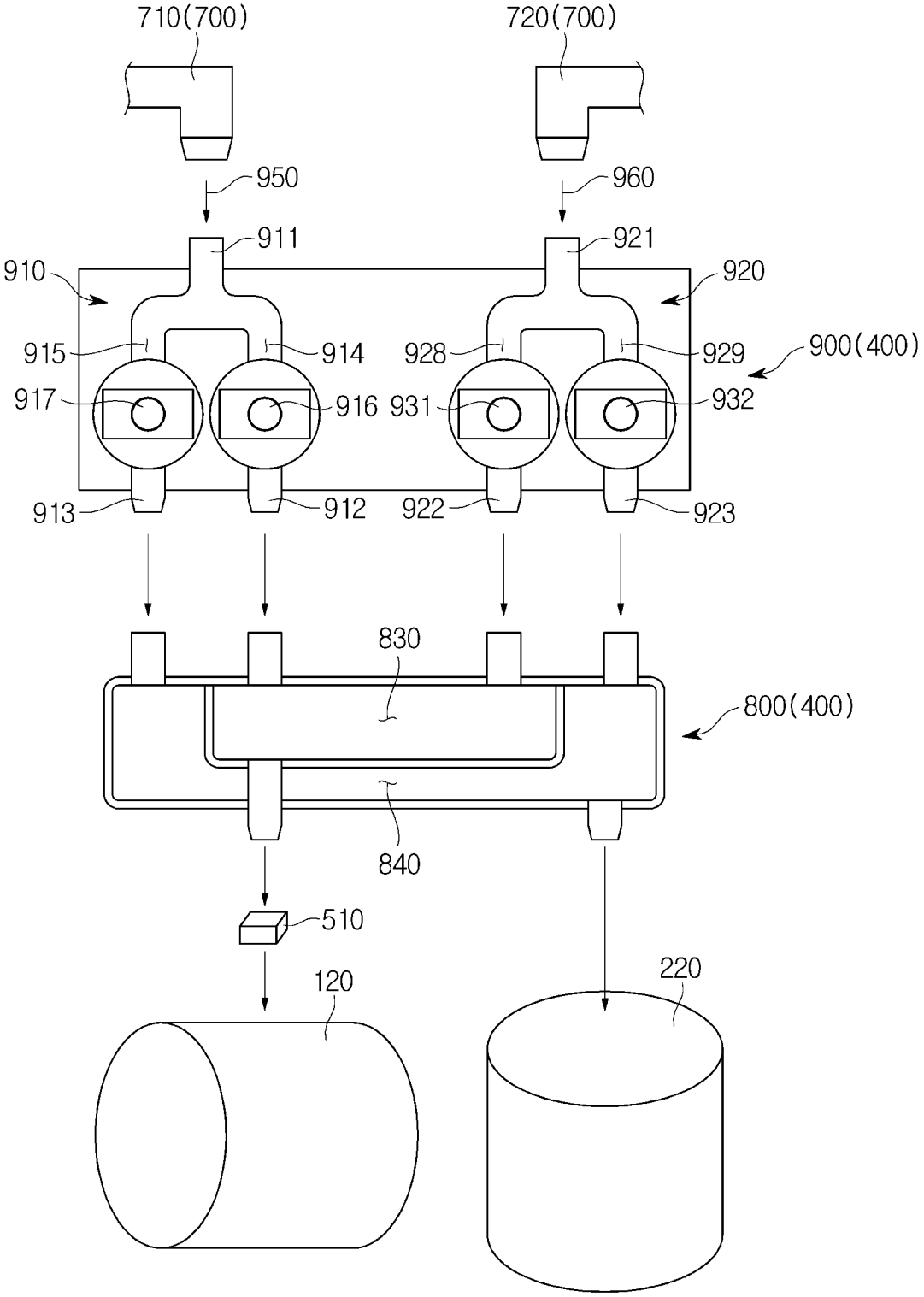
FIG. 6 is a schematic view illustrating a water supply path in a washing machine according to an embodiment.

FIG. 6 is a schematic view illustrating a water supply path in a washing machine according to an embodiment. Hereinafter, a case in which the water supply connector 800 according to the first exemplary embodiment is applied will be exemplarily described.

As illustrated in FIG. 6, the external water source 700 may include the hot water source 710 to supply hot water and the cold water source 720 to supply cold water.

The water supply device 400 may include the water supply connector 800 including the plurality of chambers 830 and 840 separated from each other and the water supply valve 900 provided to control the supply of wash water. The water supply valve 900 may be disposed between the external water source 700 and the water supply connector 800. In addition, the water supply valve 900 may be connected to the external water source 700 and the water supply connector 800.

The plurality of chambers 830 and 840 of the water supply connector 800 may include a first chamber 830 and a second chamber 840 formed outside the first chamber 830. However, the relationship between the positions of the plurality of chambers 830 and 840 is not limited thereto and may be modified in various manners.

The water supply valve 900 may include the first valve unit 910 connected to the hot water source 710 and the water supply connector 800 and the second valve unit 920 connected to the cold water source 720 and the water supply connector 800.

The first valve unit 910 may include the water source coupler connected to the hot water source 710. The first valve unit 910 may further include a plurality of connector couplers connected to the water supply connector 800. The plurality of connector couplers may include a first hot water connector coupler 912 connected to the first chamber 830 and a second hot water connector coupler 913 connected to the second chamber 840. The first valve unit 910 may further include a plurality of valve channels connecting the water source coupler 911 with each of the connector couplers to allow hot water to flow therethrough. The plurality of valve channels may include a first valve channel 914 connecting the water source coupler 911 with the first hot water connector coupler 912 to allow hot water to flow therethrough and a second valve channel 915 connecting the water source coupler 911 with the second hot water connector coupler 913 to allow hot water to flow therethrough. The first valve unit 910 may further include a plurality of valves disposed at each of the valve channels to control the supply of hot water. The plurality of valves may further include a first valve disposed at the first valve channel 914 and a second valve 917 disposed at the second valve channel 915.

The second valve unit 920 may include the water source coupler 921 connected to the cold water source 720. The second valve unit 920 may further include a plurality of connector couplers connected to the water supply connector 800. The plurality of connector couplers may include a first cold water connector coupler 922 connected to the first chamber 830 and a second cold water connector coupler 923 connected to the second chamber 840. The second valve unit 920 may further include a plurality of valve channels connecting the water source coupler 921 with each of the plurality of connector couplers to allow cold water to flow therethrough. The plurality of valve channels may include a first valve channel 928 connecting the water source coupler 921 with the first cold water connector coupler 922 and a second valve channel 929 connecting the water source coupler 921 with the second cold water connector coupler 923 to allow cold water to flow therethrough. The second valve unit 920 may further include a plurality of valves disposed at each of the plurality of valve channels to control the supply of cold water. The plurality of valves may further include a first valve 931 disposed at the first valve channel 928 and a second valve 932 disposed at the second valve channel 929.

The washing machine 1 may further include a first water supply channel 950 connecting the external water source 700 with the first tub 120. The external water source 700, the water supply device 400, and the first tub 120 may be disposed in the first water supply channel 950. Specifically, the external water source 700, the first valve channel 914 of the first valve unit 910, the first valve channel 928 of the second valve unit 920, the first chamber 830 of the water supply connector 800, and the first tub 120 may be disposed in the first water supply channel 950. The first detergent case 510 may further be disposed in the first water supply channel 950.

Hereinafter, a flow of wash water flowing through the first water supply channel 950 will be described.

Hot water supplied from the hot water source 710 flows into the first valve channel 914 through the water source coupler 911 of the first valve unit 910 and the hot water contained the first valve channel 914 is supplied to the first chamber 830 of the water supply connector 800 when a first valve 916 is switched on. Cold water supplied from the cold water source 720 flows into the first valve channel 928 through the water source coupler 921 of the second valve unit 920 and the cold water contained in the first valve channel 928 is supplied to the first chamber 830 of the water supply connector 800 when the first valve 931 is switched on. In this case, hot water and cold water may be mixed in the first chamber 830. The wash water mixed in the first chamber 830 passes through the first detergent case 510 and is supplied to the first tub 120 together with the laundry detergent stored in the first detergent case 510. However, when one of the first valve 916 of the first valve unit 910 and the first valve 931 of the second valve unit 920 is in an off state, one of hot water and cold water may only be supplied to the first tub 120.

The washing machine 1 may further include a second water supply channel 960 connecting the external water source 700 with the second tub 220. The external water source 700, the water supply device 400, and the second tub 220 may be disposed in the second water supply channel 960. Specifically, the external water source 700, the second valve channel 915 of the first valve unit 910, the second valve channel 929 of the second valve unit 920, the second chamber 840 of the water supply connector 800, and the second tub 220 may be disposed in the second water supply channel 960.

Hereinafter, a flow of wash water flowing through the second water supply channel 960 will be described.

How water supplied from the hot water source 710 flows into the second valve channel 915 through the water source coupler 911 of the first valve unit 910 and the hot water contained in the second valve channel 915 is supplied to the second chamber 840 of the water supply connector 800 when a second valve 917 is switched on. Cold water supplied from the cold water source 720 flows into the second valve channel 929 through the water source coupler 921 of the second valve unit 920 and the cold water contained in the second valve channel 929 is supplied to the second chamber 840 of the water supply connector 800 when the second cold water connector coupler 923 is switched on. In this case, hot water and cold water may be mixed in the second chamber 840. The wash water mixed in the second chamber 840 is supplied to the second tub 220. However, when one of the second valve 917 of the first valve unit 910 and the second valve 932 of the second valve unit 920 is in an off state, one of hot water and cold water may only be supplied to the second tub 220.

The first water supply channel 950 and the second water supply channel 960 may cross each other at the water supply connector 800.

Figure 7:
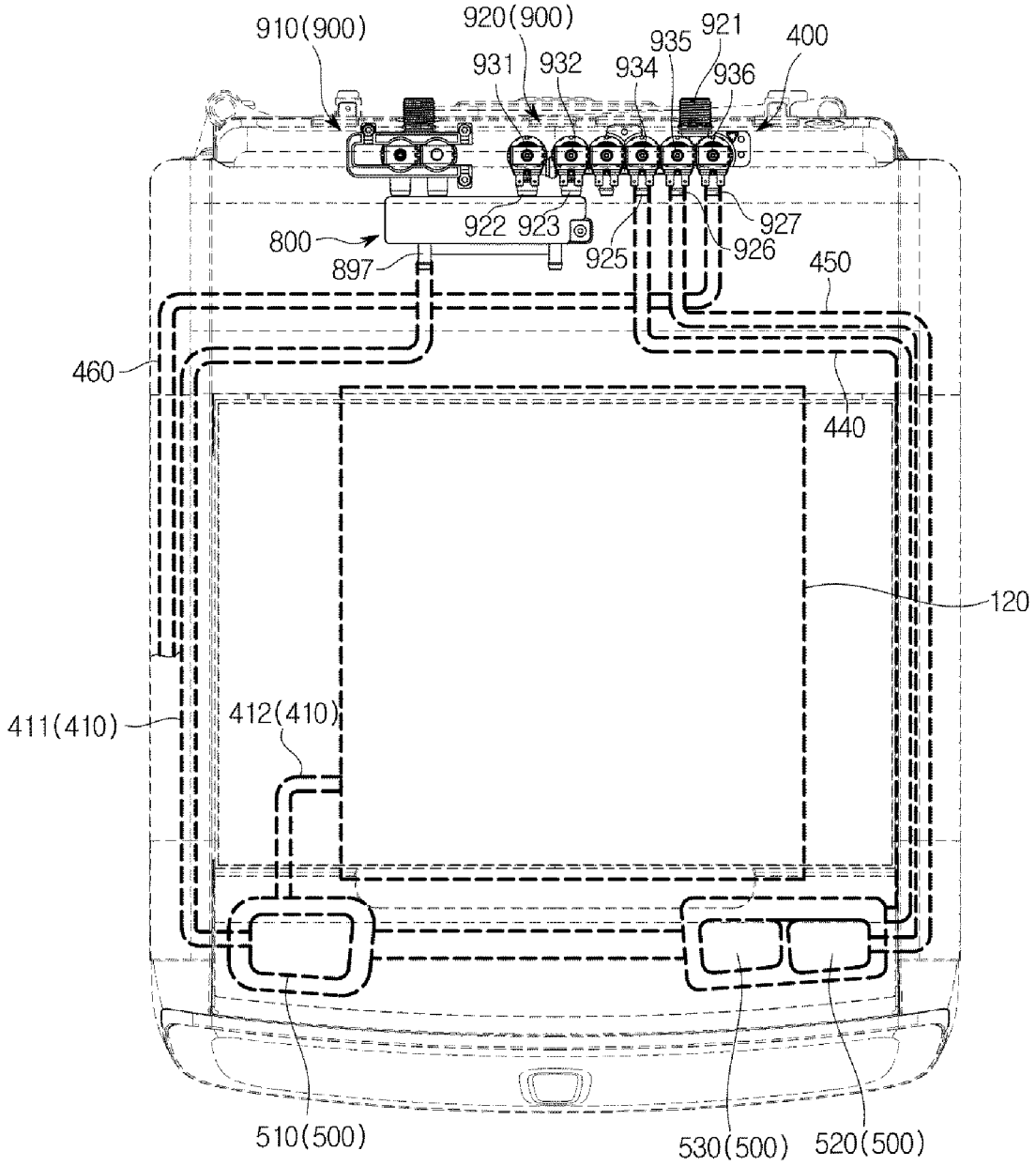
FIG. 7 is a top view of a washing machine according to an embodiment illustrating a connection relationship among a water supply device, a first detergent supply device, a spray nozzle, and a first tub.
Figure 8A:
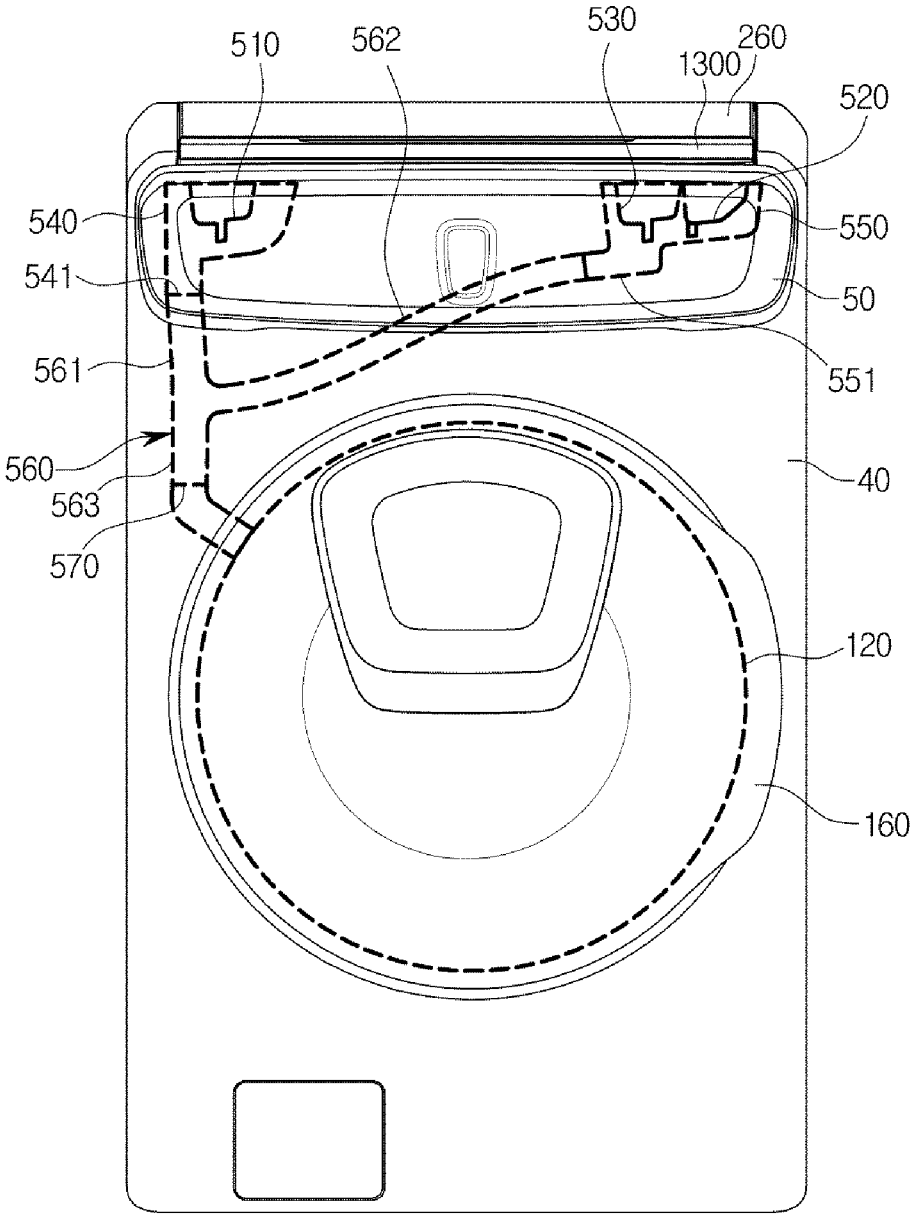
FIG. 8A is a front view of the washing machine illustrating a connection relationship between the first detergent supply device and the first tub.
Figure 8B:
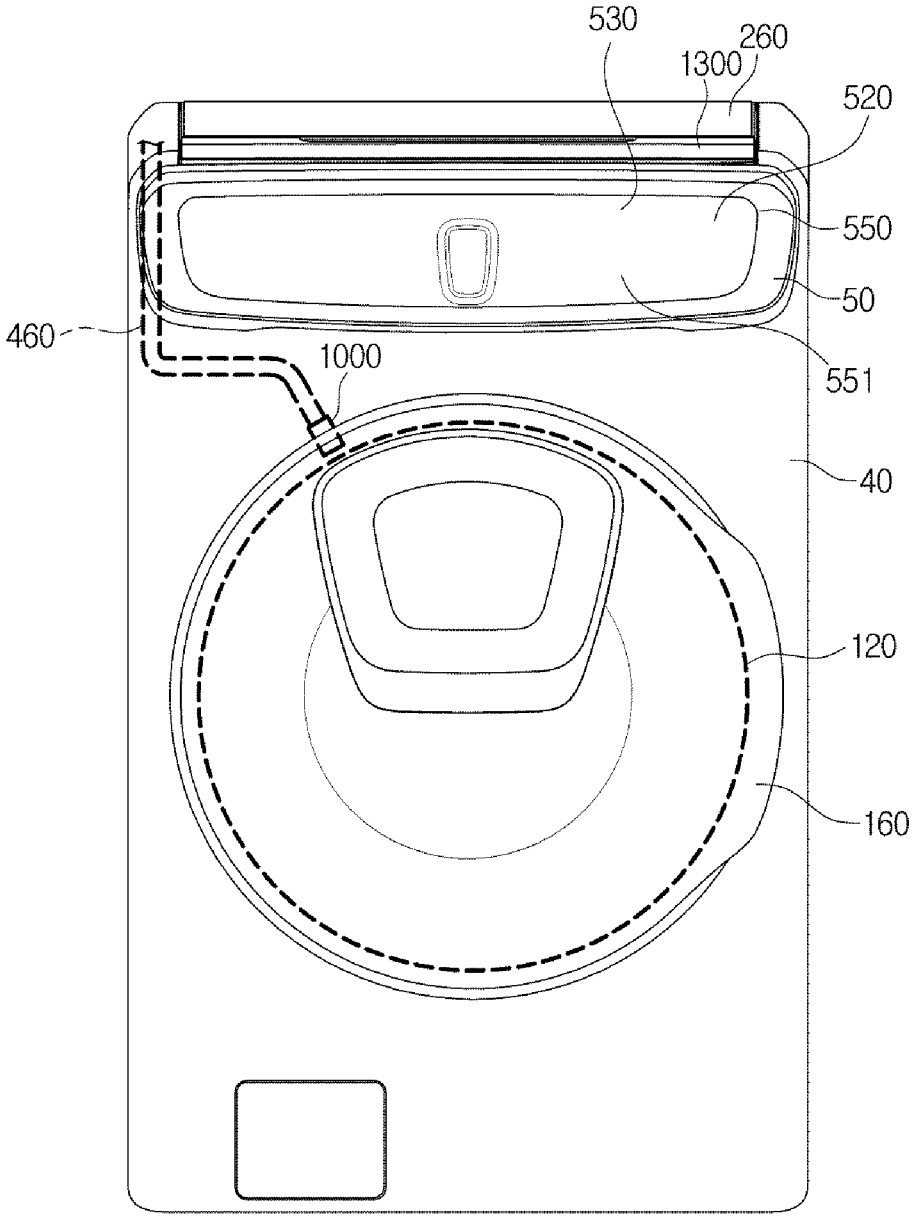
FIG. 8B is a front view of the washing machine illustrating a connection relationship between the spray nozzle and the first tub.
Figure 9:
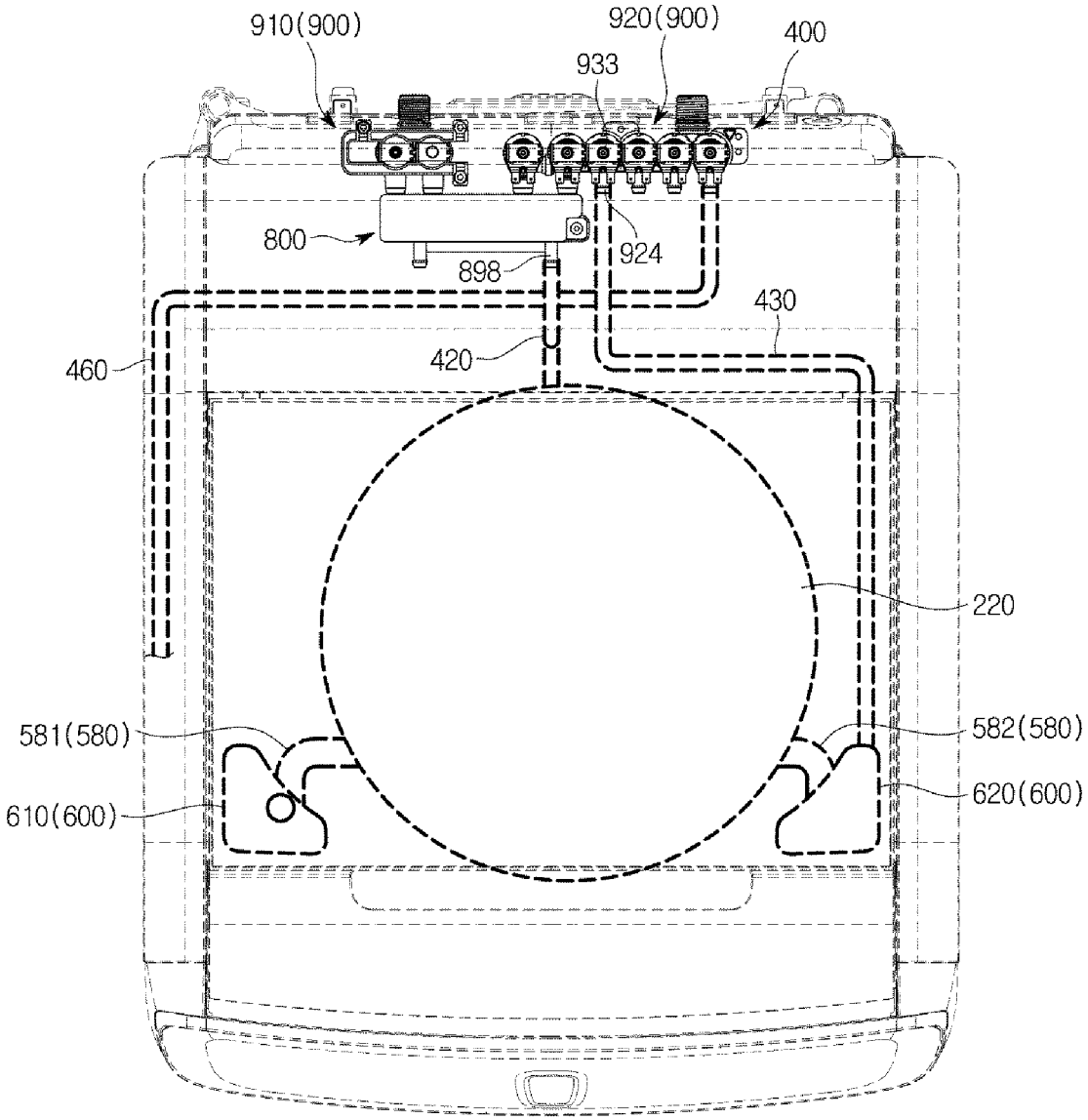
FIG. 9 is a top view illustrating a connection relationship among the water supply device, a second detergent supply device, and a second tub.

FIG. 7 is a top view of a washing machine according to an embodiment illustrating a connection relationship among a water supply device, a first detergent supply device, a spray nozzle, and a first tub. FIG. 8A is a front view of the washing machine illustrating a connection relationship between the first detergent supply device and the first tub. FIG. 8B is a front view of the washing machine illustrating a connection relationship between the spray nozzle and the first tub. FIG. 9 is a top view illustrating a connection relationship among the water supply device, a second detergent supply device, and a second tub. Hereinafter, a case where the water supply connector 800 according to the first exemplary embodiment is applied will be described as an example. Hereinafter, descriptions of the first valve unit 910 given above with reference to FIGS. 4 to 6 will not be repeated. Here, a first inlet pipe 561 and an outlet pipe 563 illustrated in FIG. 8A may constitute a part of a second hose 412 of a first water supply hose 410.

As illustrated in FIGS. 7 to 9, the water supply device 400 may further include the first water supply hose 410 connecting the water supply connector 800 with the first tub 120. The first water supply hose 410 may include a first hose 411 connecting the water supply connector 800 with the first detergent case 510. The first water supply hose 410 may further include the second hose 412 connecting the first detergent case 510 with the first tub 120. Particularly, the first water supply hose 410 may connect a first discharge nozzle 897 communicating with the first chamber 830 of the water supply connector 800 and the first tub 120. That is, the first water supply hose 410 may include the first hose 411 connecting the first discharge nozzle 897 with the first detergent case 510 and the second hose 412 connecting the first detergent case 510 with the first tub 120.

The water supply device 400 may further include a second water supply hose 420 connecting the water supply connector 800 with the second tub 220. Particularly, the second water supply hose 420 may connect a second discharge nozzle 898 communicating with the second chamber 840 of the water supply connector 800 and the second tub 220.

A part of the second valve unit 920 may be connected to the water supply connector 800. The other part of the second valve unit 920 may be connected to elements requiring the supply of cold water. The elements requiring the supply of cold water may include the second detergent case 520 of the first detergent supply device 500, the third detergent case 530 of the first detergent supply device 500, a second detergent case 620 of the second detergent supply device 600, and a spray nozzle 1000. Particularly, the second valve unit 920 may include the water source coupler 921 connected to the cold water source 720. The second valve unit 920 may further include a plurality of connector couplers connected to the water supply connector 800. The plurality of connector couplers may include the first cold water connector coupler 922 connected to the first chamber 830 and the second cold water connector coupler 923 connected to the second chamber 840. The second valve unit 920 may further include a third coupler 924 connected to the second detergent case 620 of the second detergent supply device 600. The second valve unit 920 may further include a fourth coupler 925 connected to the third detergent case 530 of the first detergent supply device 500. The second valve unit 920 may further include a fifth coupler 926 connected to the second detergent case 520 of the first detergent supply device 500. The second valve unit 920 may further include a sixth coupler 927 connected to the spray nozzle 1000. The spray nozzle 1000 may be installed at the first tub 120 to spray wash water to the first door 160. Alternatively, the spray nozzle 1000 may be installed at the first tub 120 to supply additional wash water toward the first washing space 115. Alternatively, the spray nozzle 1000 may be installed at the first tub 120 to spray wash water toward the diaphragm 121. The second valve unit 920 may further include a plurality of valve channels connecting the water source coupler 921 with the plurality of connector couplers and connecting the water source coupler 921 with the plurality of couplers to allow cold water to flow therethrough. The plurality of valve channels may include the first valve channel 928 connecting the water source coupler 921 with the first cold water connector coupler 922 to allow cold water to flow therethrough and the second valve channel 929 connecting the water source coupler 921 with the second cold water connector coupler 923 to allow cold water to flow therethrough. In addition, the plurality of valve channels may further include a third valve channel (not shown) connecting the water source coupler 921 with the third coupler 924, a fourth valve channel (not shown) connecting the water source coupler 921 with the fourth coupler 925, a fifth valve channel (not shown) connecting the water source coupler 921 with the fifth coupler 926, and a sixth valve channel (not shown) connecting the water source coupler 921 with the sixth coupler 927 to allow cold water to flow therethrough. The second valve unit 920 may further include a plurality of valves disposed at each of the plurality of valve channels to control the supply of cold water. The plurality of valves may include the first valve 931 disposed at the first valve channel 928 and the second valve 932 disposed at the second valve channel 929. The plurality of valves may further include a third valve 933 disposed at the third valve channel, a fourth valve 934 disposed at the fourth valve channel, a fifth valve 935 disposed at the fifth valve channel, and a sixth valve 936 disposed at the sixth valve channel.

The water supply device 400 may further include a third water supply hose 430 connecting the third coupler 924 with the second detergent case 620 of the second detergent supply device 600.

The water supply device 400 may further include a fourth water supply hose 440 connecting the fourth coupler 925 with the third detergent case 530 of the first detergent supply device 500.

The water supply device 400 may further include a fifth water supply hose 450 connecting the fifth coupler 926 with the second detergent case 520 of the first detergent supply device 500.

The water supply device 400 may further include a sixth water supply hose 460 connecting the sixth coupler 927 with the spray nozzle 1000.

The first detergent case 510 may be covered by a first detergent case cover 540 in communication with the first detergent case cover 540. The first detergent case cover 540 may include a first connection pipe 541 connected to the first inlet pipe 561 of a detergent supply hose 560 which will be described later.

In addition, the second detergent case 520 may be covered by a second detergent case cover 550 in communication with the second detergent case cover 550. The second detergent case cover 550 may include a second connection pipe 551 connected to a second inlet pipe 562 of the detergent supply hose 560.

Also, the first tub 120 may include a third connection pipe 570 connected to the outlet pipe 563 of the detergent supply hose 560. The third connection pipe 570 may guide wash water and/or a detergent introduced through the outlet pipe 563 to the first tub 120.

The first detergent supply device 500 may include the detergent supply hose 560 connecting the plurality of detergent cases 510, 520, and 530 with the first tub 120 to guide detergents stored in the plurality of detergent cases 510, 520, and 530 to the first tub 120. The detergent supply hose 560 may guide detergents stored in the first detergent case 510 and the second detergent case 520 to the first tub 120. To this end, the detergent supply hose 560 may include the first inlet pipe 561 connected to the first detergent case 510, the second inlet pipe 562 connected to the second detergent case 520, and the outlet pipe 563 connected to the first tub 120. That is, the detergent supply hose 560 may be connected to the first tub 120 through the outlet pipe 563 where the first inlet pipe 561 and the second inlet pipe 562 are joined.

If the plurality of detergent cases 510, 520, and 530 includes the third detergent case 530, the third detergent case 530 may be connected to the second inlet pipe 562 that is connected to the second detergent case 520. Accordingly, the third detergent case 530 may be guided to the first tub 120 through the second inlet pipe 562 and the outlet pipe 563. Specifically, the first inlet pipe 561 may be connected to the first detergent case cover 540 communicating with the first detergent case 510 and the second inlet pipe 562 may be connected to the second detergent case cover 550 communicating with the second detergent case 520 and/or the third detergent case 530. The outlet pipe 563 may be connected to the third connection pipe 570 communicating with the first tub 120.

The detergent supply hose 560 may be configured such that the first inlet pipe 561, the second inlet pipe 562, and the outlet pipe 563 are joined at a position higher than the first tub 120. That is, the detergent supply hose 560 may be provided such that the first inlet pipe 561 and the second inlet pipe 562 are joined at a position higher than the first tub 120.

The second detergent supply device 600 may include a detergent supply hose 580 connecting the plurality of detergent cases 610 and 620 with the second tub 220 to guide a fabric softener and/or a bleach stored in the plurality of detergent cases 610 and 620 to the second tub 220. The detergent supply hose 580 may guide the bleach stored in the first detergent case 610 and the fabric softener stored in the second detergent case 620 to the second tub 220. To this end, the detergent supply hose 580 may include a fourth inlet pipe 581 connecting the first detergent case 610 with the second tub 220 and a fifth inlet pipe 582 connecting the second detergent case 620 with the second tub 220. When the bleach is stored in the first detergent case 610 of the second detergent supply device 600, wash water is not supplied to the first detergent case 610. The bleach stored in the first detergent case 610 is supplied to the second tub 220 through the fourth inlet pipe 581.

Figure 10:
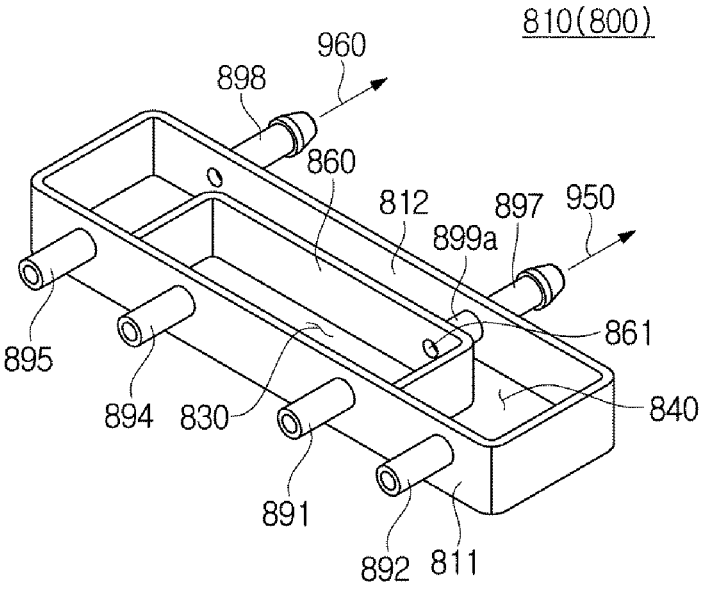
FIG. 10 is a perspective view illustrating a water supply connector according to the first exemplary embodiment of the present disclosure.

FIG. 10 is a perspective view illustrating a water supply connector according to the first exemplary embodiment of the present disclosure. Hereinafter, descriptions given above with reference to FIG. 5 will not be repeated. In FIG. 10, the connector cover 820 is omitted.

As illustrated in FIG. 10, the water supply connector 800 may include a connector housing 810. The water supply connector 800 may further include a plurality of chambers 830 and 840 therein. Specifically, the plurality of chambers 830 and 840 may be formed in the connector housing 810. The plurality of chambers 830 and 840 may include a first chamber 830 and a second chamber 840 formed outside the first chamber 830 along the outer periphery of the first chamber 830. The first chamber 830 may be disposed in the first water supply channel 950 and the second chamber 840 may be disposed in the second water supply channel 960. The water supply connector 800 may further include a partition wall 860 that separate the plurality of chambers 830 and 840 from each other. That is, the water supply connector 800 may further include the partition wall 860 that separates the first chamber 830 and the second chamber 840 from each other. The partition wall 860 may have a first communication hole 861 communicating with one of the first water supply channel 950 and the second water supply channel 960. In FIG. 10, the partition wall 860 may have the first communication hole 861 communicating with the first water supply channel 950. The water supply connector 800 may further include a plurality of hot water inflow nozzles to supply hot water to each of the plurality of chambers 830 and 840. The plurality of hot water inflow nozzles may include a first hot water inflow nozzle 891 to supply hot water to the first chamber 830 and a second hot water inflow nozzle 892 to supply hot water to the second chamber 840. The water supply connector 800 may further include a plurality of cold water inflow nozzles to supply cold water to the plurality of chambers 830 and 840. The plurality of cold water inflow nozzles may include a first cold water inflow nozzle 894 to supply cold water to the first chamber 830 and a second cold water inflow nozzle 895 to supply cold water to the second chamber 840. The first hot water inflow nozzle 891 and the first cold water inflow nozzle 894 may protrude from a first wall 811 of the connector housing 810 to be spaced apart from each other. The second hot water inflow nozzle 892 and the second cold water inflow nozzle 895 may protrude from the first wall 811 of the connector housing 810 to be spaced apart from each other. A distance between the first hot water inflow nozzle 891 and the first cold water inflow nozzle 894 may be smaller than that between the second hot water inflow nozzle 892 and the second cold water inflow nozzle 895. The water supply connector 800 may further include a plurality of discharge nozzles to discharge wash water out of the plurality of chambers 830 and 840 respectively. The plurality of discharge nozzles may include the first discharge nozzle 897 protruding from a second wall 812 of the connector housing 810 facing the first wall 811 to discharge wash water out of the first chamber 830. The plurality of discharge nozzles may further include a second discharge nozzle 898 protruding from the second wall 812 of the connector housing 810 facing the first wall 811 to discharge wash water out of the second chamber 840. The water supply connector 800 may further include a connection flow path 899*a* that connects the first chamber 830 and the first discharge nozzle 897. The connection flow path 899*a* may be formed across the second chamber 840 so as not to communicate with the second chamber 840. The connection flow path 899*a* may not be spaced apart from the bottom surface of the second chamber 840. That is, the connection flow path 899*a* may be integrated with the bottom surface of the second chamber 840. Alternatively, the connection flow path 899*a* may be spaced apart from the bottom surface of the second chamber 840 at a predetermined interval.

Hot water introduced through the first hot water inflow nozzle 891 and cold water introduced through the first cold water inflow nozzle 894 are mixed in the first chamber 830, pass through the first communication hole 861, and are discharged out of the water supply connector 800 sequentially through the connection flow path 899*a* and the first discharge nozzle 897. Wash water discharged out of the water supply connector 800 flows into the first tub 120 via the first detergent case 510.

Hot water introduced through the second hot water inflow nozzle 892 and cold water introduced through the second cold water inflow nozzle 895 are mixed in the second chamber 840 and discharged out of the water supply connector 800 through the second discharge nozzle 898. Wash water discharged out of the water supply connector 800 flows into the second tub 220.

Figure 11:
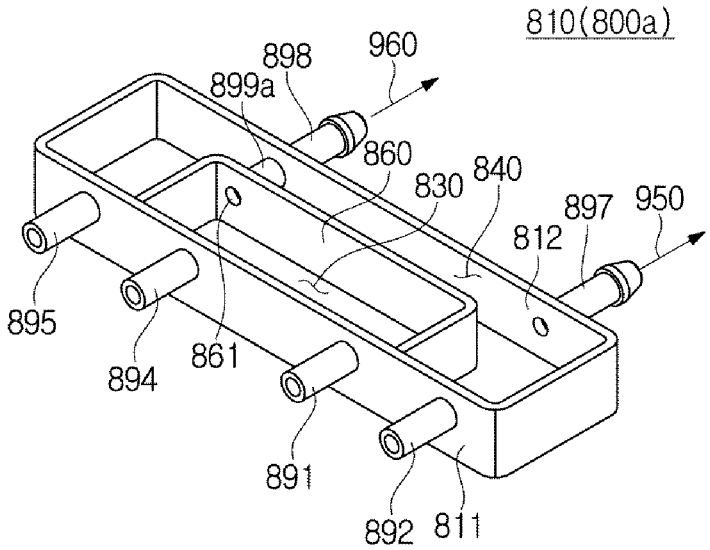
FIG. 11 is a perspective view of a water supply connector of a washing machine according to a second exemplary embodiment.

FIG. 11 is a perspective view of a water supply connector of a washing machine according to a second exemplary embodiment. Hereinafter, descriptions given above with reference to FIG. 5 will not be repeated. In FIG. 11, the connector cover 820 is omitted.

As illustrated in FIG. 11, a water supply connector 800*a* may include a connector housing 810. The water supply connector 800*a* may further include a plurality of chambers 830 and 840 therein. Specifically, the plurality of chambers 830 and 840 may be formed in the connector housing 810. The plurality of chambers 830 and 840 may include a first chamber 830 and a second chamber 840 formed outside the first chamber 830 along the outer periphery of the first chamber 830. The first chamber 830 may be disposed in the second water supply channel 960 and the second chamber 840 may be disposed in the first water supply channel 950. The water supply connector 800*a* may further include a partition wall 860 that separates the plurality of chambers 830 and 840 from each other. That is, the water supply connector 800*a* may further include the partition wall 860 that separates the first chamber 830 and the second chamber 840 from each other. The partition wall 860 may have a first communication hole 861 communicating with one of the first water supply channel 950 and the second water supply channel 960. In FIG. 11, the partition wall 860 may have the first communication hole 861 communicating with the second water supply channel 960. Descriptions of the plurality of hot water inflow nozzles, the plurality of cold water inflow nozzles, the plurality of discharge nozzles, and the connection flow path 899*a* given above with reference to FIG. 10 will not be repeated herein.

Hot water introduced through the first hot water inflow nozzle 891 and cold water introduced through the first cold water inflow nozzle 894 are mixed in the first chamber 830, pass through the first communication hole 861, and are discharged out of the water supply connector 800*a* sequentially through the connection flow path 899*a* and the second discharge nozzle 898. Wash water discharged out of the water supply connector 800*a* flows into the second tub 220.

Hot water introduced through the second hot water inflow nozzle 892 and cold water introduced through the second cold water inflow nozzle 895 are mixed in the second chamber 840 and discharged out of the water supply connector 800*a* through the first discharge nozzle 897. Wash water discharged out of the water supply connector 800*a* flows into the first tub 120 via the first detergent case 510.

Figure 12:
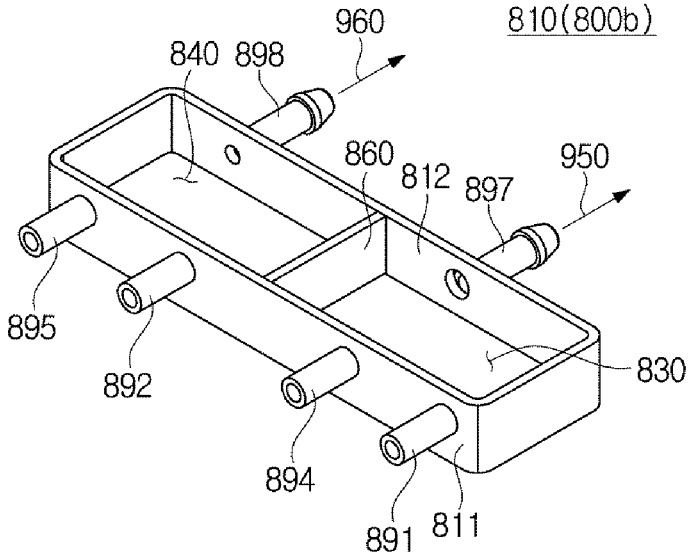
FIG. 12 is a perspective view of a water supply connector of a washing machine according to a third exemplary embodiment.

FIG. 12 is a perspective view of a water supply connector of a washing machine according to a third exemplary embodiment. Hereinafter, descriptions given above with reference to FIG. 5 will not be repeated. In FIG. 12, the connector cover 820 is omitted.

As illustrated in FIG. 12, a water supply connector 800*b* may include a connector housing 810. The water supply connector 800*b* may further include a plurality of chambers 830 and 840 therein. Specifically, the plurality of chambers 830 and 840 may be formed in the connector housing 810. The plurality of chambers 830 and 840 may include a first chamber 830 and a second chamber 840. The first chamber 830 may be disposed in the first water supply channel 950 and the second chamber 840 may be disposed in the second water supply channel 960. The water supply connector 800*b* may further include a partition wall 860 that separates the plurality of chambers 830 and 840 from each other. That is, the water supply connector 800*b* may further include the partition wall 860 that separates the first chamber 830 and the second chamber 840 from each other. The water supply connector 800*b* may further include a plurality of hot water inflow nozzle to supply hot water to each of the plurality of chambers 830 and 840. The plurality of hot water inflow nozzles may include the first hot water inflow nozzle 891 to supply hot water to the first chamber 830 and the second hot water inflow nozzle 892 to supply hot water to the second chamber 840. The water supply connector 800*b* may further include a plurality of cold water inflow nozzles to supply cold water to each of the plurality of chambers 830 and 840. The plurality of cold water inflow nozzles may include the first cold water inflow nozzle 894 to supply cold water to the first chamber 830 and the second cold water inflow nozzle 895 to supply cold water to the second chamber 840. The first hot water inflow nozzle 891 and the first cold water inflow nozzle 894 may protrude from the first wall 811 of the connector housing 810 to be spaced apart from each other. The second hot water inflow nozzle 892 and the second cold water inflow nozzle 895 may protrude from the first wall 811 to be spaced apart from each other. A distance between the first hot water inflow nozzle 891 and the second cold water inflow nozzle 895 may be greater than that between the second hot water inflow nozzle 892 and the first cold water inflow nozzle 894. However, a distance between the first hot water inflow nozzle 891 and the second hot water inflow nozzle 892 may also be designed to be smaller than that between the first cold water inflow nozzle 894 and the second cold water inflow nozzle 895. The water supply connector 800*b* may further include a plurality of discharge nozzles to discharge wash water out of the plurality of chambers 830 and 840 respectively. The plurality of discharge nozzles may include the first discharge nozzle 897 protruding from the second wall 812 of the connector housing 810 facing the first wall 811 to discharge wash water out of the first chamber 830. The plurality of discharge nozzles may further include a second discharge nozzle 898 protruding from the second wall 812 of the connector housing 810 facing the first wall 811 to discharge wash water out of the second chamber 840.

Hot water introduced through the first hot water inflow nozzle 891 and cold water introduced through the first cold water inflow nozzle 894 are mixed in the first chamber 830 and discharged out of the water supply connector 800 through the first discharge nozzle 897. Wash water discharged out of the water supply connector 800*b* flows into the first tub 120 via the first detergent case 510.

Hot water introduced through the second hot water inflow nozzle 892 and cold water introduced through the second cold water inflow nozzle 895 are mixed in the second chamber 840 and discharged out of the water supply connector 800*b* through the second discharge nozzle 898. Wash water discharged out of the water supply connector 800*b* flows into the second tub 220.

Figure 13:
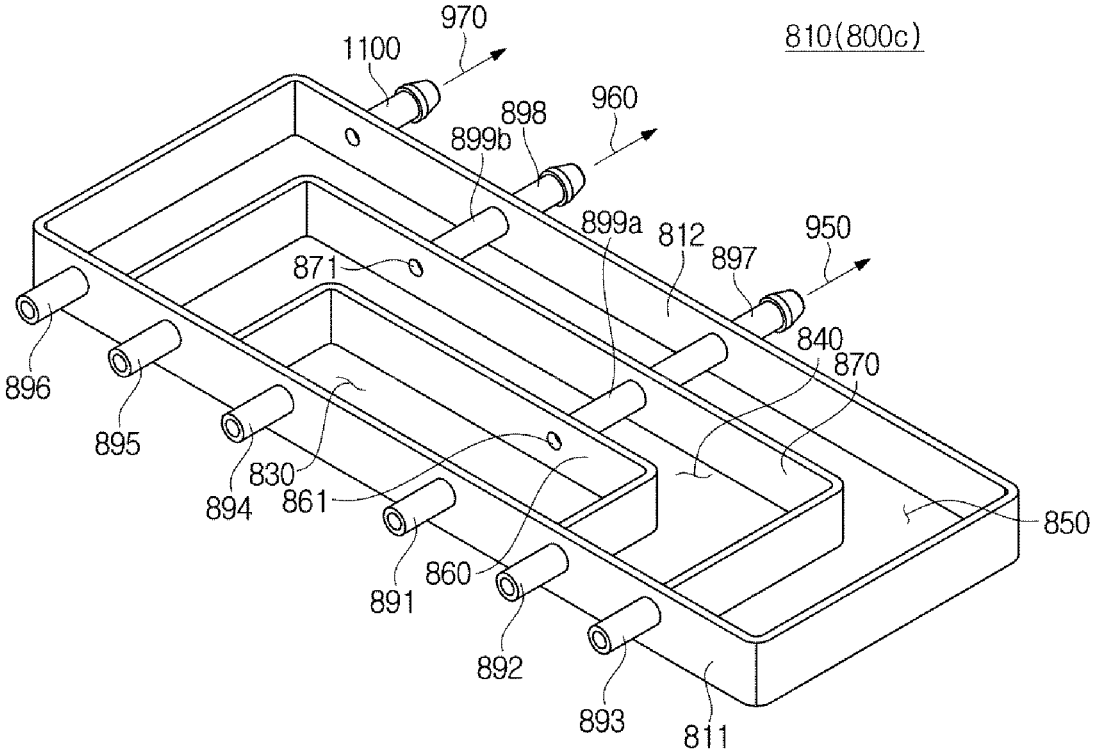
FIG. 13 is a perspective view of a water supply connector of a washing machine according to a fourth exemplary embodiment.

FIG. 13 is a perspective view of a water supply connector of a washing machine according to a fourth exemplary embodiment. Hereinafter, descriptions given above with reference to FIG. 5 will not be repeated. In FIG. 13, the connector cover 820 is omitted.

As illustrated in FIG. 13, a water supply connector 800*c* may include a connector housing 810. The water supply connector 800*c* may further include a plurality of chambers 830, 840, and 850 therein. Specifically, the plurality of chambers 830, 840, and 850 may be formed in the connector housing 810. The plurality of chambers 830, 840, and 850 may include the first chamber 830 and the second chamber 840 formed outside the first chamber 830 along the outer periphery of the first chamber 830. The plurality of chambers 830, 840, and 850 may further include a third chamber 850 formed outside the second chamber 840 along the outer periphery of the second chamber 840. The first chamber 830 may be disposed in the first water supply channel 950 and the second chamber 840 may be disposed in the second water supply channel 960. The washing machine 1 may further include a third water supply channel 970 connecting the external water source 700 with the spray nozzle 1000 installed at the first tub 120 so as not to communicate with the first water supply channel 950 and the second water supply channel 960. The third chamber 850 may be disposed in the third water supply channel 970. Specifically, the external water source 700, the water supply device 400, and the spray nozzle 1000 may be disposed in the third water supply channel 970. Particularly, the external water source 700, the third chamber 850 of the water supply connector 800*c*, and the spray nozzle 1000 may be disposed in the third water supply channel 970. The water supply connector 800*c* may further include a plurality of partition walls that separate the plurality of chambers 830, 840, and 850 from each other. The plurality of partition walls may include a first partition wall 860 that separates the first chamber 830 and the second chamber 840 from each other. The first partition wall 860 may have a first communication hole 861 communicating with one channel selected from the first water supply channel 950, the second water supply channel 960, and the third water supply channel 970. In FIG. 13, the first partition wall 860 may have a first communication hole 861 communicating with the first water supply channel 950. The plurality of partition walls may further include a second partition wall 870 that separates the third chamber 850 from the first chamber 830 and the second chamber 840. Specifically, the second partition wall 870 may separate the second chamber 840 and the third chamber 850 from each other. The second partition wall 870 may have a second communication hole 871 communicating with another channel selected from the first water supply channel 950, the second water supply channel 960, and the third water supply channel 970. In FIG. 13, the second partition wall 870 may have a second communication hole 871 communicating with the second water supply channel 960. The water supply connector 800*c* may further include a plurality of hot water inflow nozzles to supply hot water to each of the plurality of chambers 830, 840, and 850. The plurality of hot water inflow nozzles may include a first hot water inflow nozzle 891 to supply hot water to the first chamber 830, a second hot water inflow nozzle 892 to supply hot water to the second chamber 840, and a third hot water inflow nozzle 893 to supply hot water to the third chamber 850. The water supply connector 800*c* may further include a plurality of cold water inflow nozzles to supply cold water to each of the plurality of chambers 830, 840, and 850. The plurality of cold water inflow nozzles may include a first cold water inflow nozzle 894 to supply cold water to the first chamber 830, a second cold water inflow nozzle 895 to supply cold water to the second chamber 840, and a third cold water inflow nozzle 896 to supply cold water to the third chamber 850. The first hot water inflow nozzle 891 and the first cold water inflow nozzle 894 may protrude from the first wall 811 of the connector housing 810 to be spaced apart from each other. The second hot water inflow nozzle 892 and the second cold water inflow nozzle 895 may protrude from the first wall 811 of the connector housing 810 to be spaced apart from each other. The third hot water inflow nozzle 893 and the third cold water inflow nozzle 896 may protrude from the first wall 811 of the connector housing 810 to be spaced apart from each other. Among a distance between the first hot water inflow nozzle 891 and the first cold water inflow nozzle 894, a distance between the second hot water inflow nozzle 892 and the second cold water inflow nozzle 895, and a distance between the third hot water inflow nozzle 893 and the third cold water inflow nozzle 896, the distance between the third hot water inflow nozzle 893 and the third cold water inflow nozzle 896 is the greatest and the distance between the first hot water inflow nozzle 891 and the first cold water inflow nozzle 894 is the smallest. The water supply connector 800*c* may further include a plurality of discharge nozzles to discharge wash water out of the plurality of chambers 830, 840, and 850 respectively. The plurality of discharge nozzles may include a first discharge nozzle 897 protruding from the second wall 812 of the connector housing 810 facing the first wall 811 to discharge wash water out of the first chamber 830. The plurality of discharge nozzles may further include a second discharge nozzle 898 protruding from the second wall 812 of the connector housing 810 facing the first wall 811 to discharge wash water out of the second chamber 840. The plurality of discharge nozzles may further include a third discharge nozzle 1100 protruding from the second wall 812 of the connector housing 810 facing the first wall 811 to discharge wash water out of the third chamber 850. The water supply connector 800*c* may further include a first connection flow path 899*a* connecting the first chamber 830 and the first discharge nozzle 897. The first connection flow path 899*a* may be formed across the second chamber 840 and the third chamber 850 so as not to communicate with the second chamber 840 and the third chamber 850. The first connection flow path 899*a* may not be spaced apart from the bottom surface of the second chamber 840 and the bottom surface of the third chamber 850. That is, the connection flow path 899*a* may be integrated with the bottom surface of the second chamber 840 and the bottom surface of the third chamber 850. Alternatively, the connection flow path 899*a* may be spaced apart from the bottom surface of the second chamber 840 and the bottom surface of the third chamber 850. The water supply connector 800*c* may further include a second connection flow path 899*b* connecting the second chamber 840 with the second discharge nozzle 898. The second connection flow path 899*b* may be formed across the third chamber 850 so as not to communicate with the third chamber 850. The second connection flow path 899*b* may not be spaced apart from the bottom surface of the third chamber 850. That is, the second connection flow path 899*b* may be integrated with the bottom surface of the third chamber 850. Alternatively, the second connection flow path 899*b* may be spaced apart from the bottom surface of the third chamber 850.

Hot water introduced through the first hot water inflow nozzle 891 and cold water introduced through the first cold water inflow nozzle 894 are mixed in the first chamber 830, pass through the first communication hole 861, and are discharged out of the water supply connector 800*c* sequentially through the first connection flow path 899*a* and the first discharge nozzle 897. Wash water discharged out of the water supply connector 800*s* flows into the first tub 120 via the first detergent case 510.

Hot water introduced through the second hot water inflow nozzle 892 and cold water introduced through the second cold water inflow nozzle 895 are mixed in the second chamber 840, pass through the second communication hole 871, and are discharged out of the water supply connector 800*c* sequentially through the second connection flow path 899*b* and the second discharge nozzle 898. Wash water discharged out of the water supply connector 800*c* flows into the second tub 220.

Hot water introduced through the third hot water inflow nozzle 893 and cold water introduced through the third cold water inflow nozzle 896 are mixed in the third chamber 850 and discharged out of the water supply connector 800*c* through the third discharge nozzle 1100. Wash water discharged out of the water supply connector 800*c* flows into the spray nozzle 1000. According to this configuration, not only cold water but also hot water or warm water may be supplied to the spray nozzle 1000.

Figure 14:
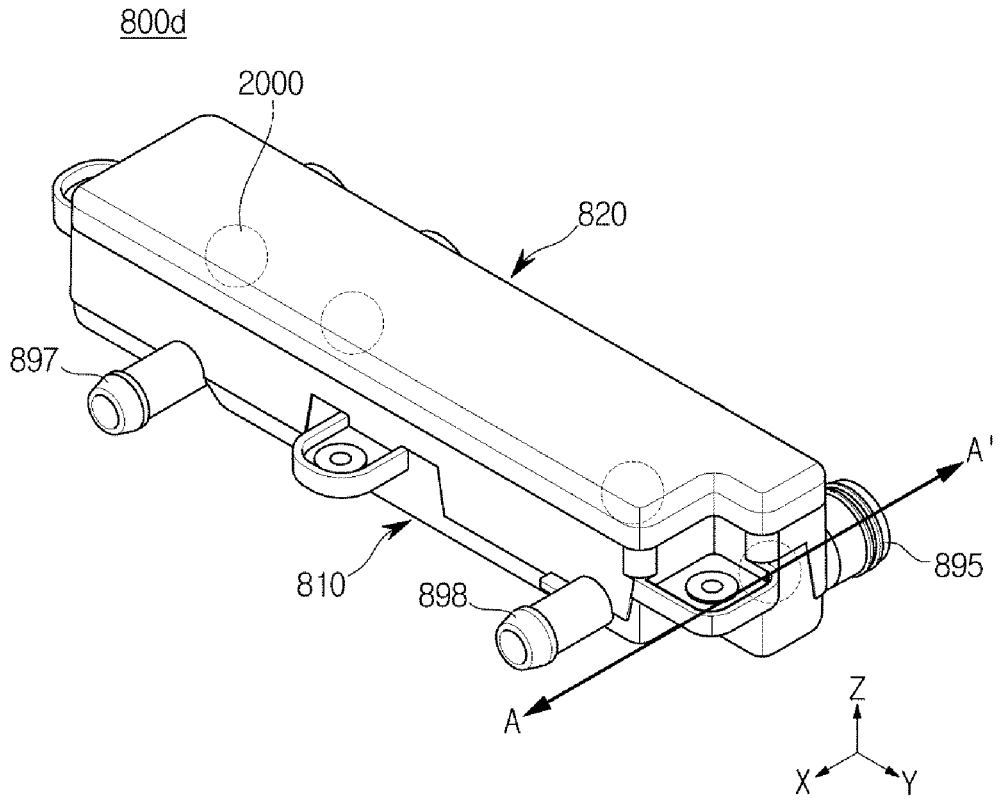
FIG. 14 is a perspective view illustrating a water supply connector of a washing machine according to a fifth exemplary embodiment of the present disclosure.
Figure 15:
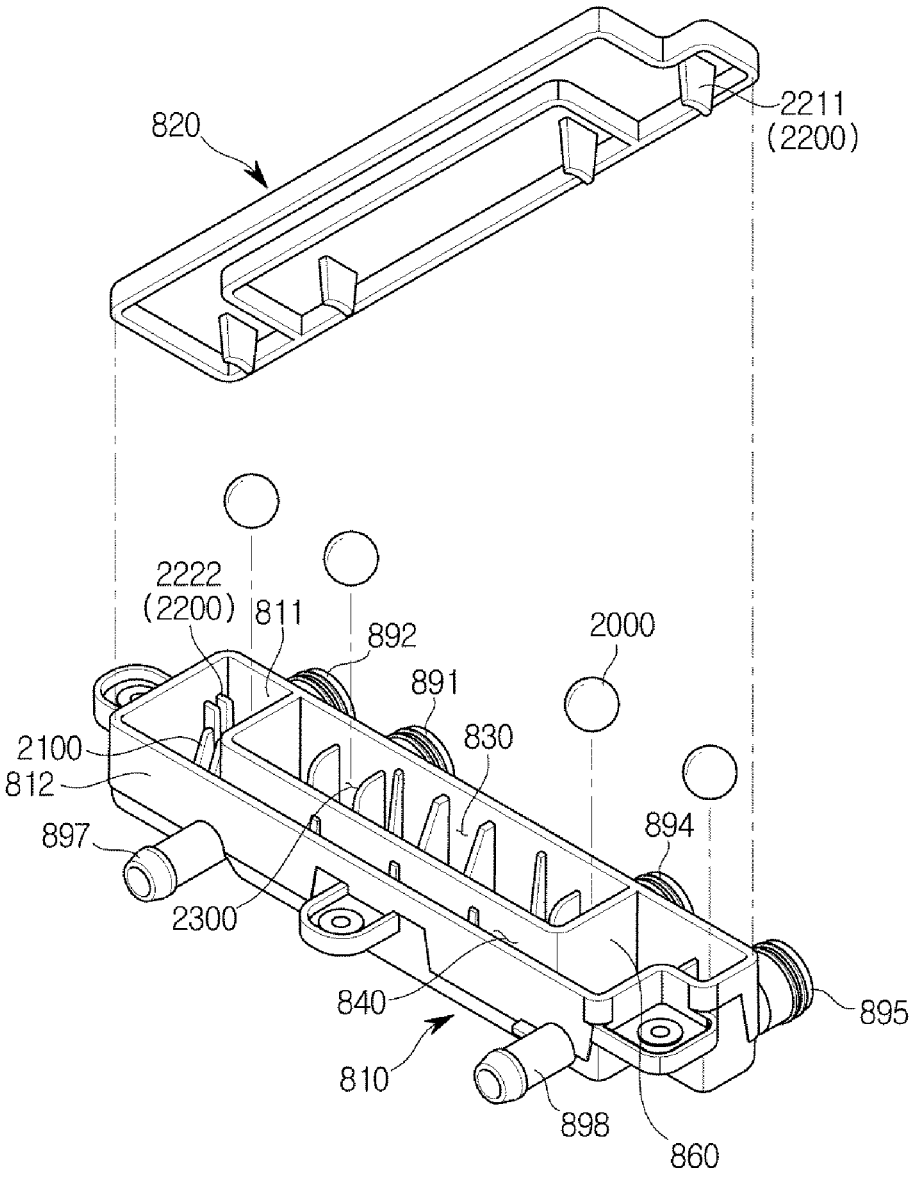
FIG. 15 is an exploded perspective view of the water supply connector of the washing machine according to the fifth exemplary embodiment.

FIG. 14 is a perspective view illustrating a water supply connector of a washing machine according to a fifth exemplary embodiment of the present disclosure. FIG. 15 is an exploded perspective view of the water supply connector of the washing machine according to the fifth exemplary embodiment. Hereinafter, descriptions given above with reference to the water supply connector 800 according to the first exemplary embodiment will not be repeated. In FIG. 14, X denotes a direction in which wash water flows into a water supply connector 800*d*, Y denotes a widthwise direction of the water supply connector 800*d*, and Z denotes a lengthwise direction of the water supply connector 800*d*.

As illustrated in FIGS. 14 and 15, the water supply connector 800*d* may include a connector housing 810. The water supply connector 800*d* may further include a plurality of chambers 830 and 840 formed in the connector housing 810. The plurality of chambers 830 and 840 may include a first chamber 830 and a second chamber 840 formed outside the first chamber 830 along the outer periphery of the first chamber 830.

The water supply connector 800*d* may further include a partition wall 860 that separates the first chamber 830 and the second chamber 840 from each other.

The water supply connector 800*d* may further include a plurality of hot water inflow nozzles to supply hot water to each of the plurality of chambers 830 and 840. The plurality of hot water inflow nozzles may include a first hot water inflow nozzle 891 to supply hot water to the first chamber 830 and a second hot water inflow nozzle 892 to supply hot water to the second chamber 840. The water supply connector 800*d* may further include a plurality of cold water inflow nozzles to supply cold water to each of the plurality of chambers 830 and 840. The plurality of cold water inflow nozzles may include a first cold water inflow nozzle 894 to supply cold water to the first chamber 830 and a second cold water inflow nozzle 895 to supply cold water to the second chamber 840. The plurality of hot water inflow nozzles and the plurality of cold water inflow nozzles may protrude from the first wall 811 of the connector housing 810 to be spaced apart from each other.

The water supply connector 800*d* may further include a plurality of inflow holes formed in the first wall 811 of the connector housing 810 to communicate with the plurality of hot water inflow nozzles and the plurality of cold water inflow nozzles respectively. Specifically, the plurality of inflow holes may include a plurality of hot water inflow holes 982 (FIG. 18) formed in the first wall 811 of the connector housing 810 to communicate with the plurality of hot water inflow nozzles respectively. Also, the plurality of inflow holes may include a plurality of cold water inflow holes 981 (FIG. 18) formed in the first wall 811 of the connector housing 810 to communicate with the plurality of cold water inflow nozzles respectively.

The water supply connector 800*d* may further include a plurality of discharge nozzles to discharge wash water out of the plurality of chambers 830 and 840 respectively. The plurality of discharge nozzles may include a first discharge nozzle 897 protruding from a second wall 812 of the connector housing 810 facing the first wall 811 to discharge wash water out of the first chamber 830. The plurality of discharge nozzles may further include a second discharge nozzle 898 protruding from the second wall 812 of the connector housing 810 facing the first wall 811 to discharge wash water out of the second chamber 840.

The water supply connector 800*d* may include a backflow prevention structure. The backflow prevention structure may be disposed in the water supply connector 800*d*. When wash water flows into the plurality of chambers 830 and 840 through one of the plurality of hot water inflow nozzles and the plurality of cold water inflow nozzles, the backflow prevention structure prevents a backflow of the wash water introduced into the plurality of chambers 830 and 840 from flowing out of the water supply connector 800*d* through another inflow nozzle among the plurality of hot water inflow nozzles and the plurality of cold water inflow nozzles. For example, when the user desires to wash laundry by using only cold water, wash water is introduced into the plurality of chambers 830 and 840 through the plurality of cold water inflow nozzles. At least a part of wash water introduced into the plurality of chambers 830 and 840 may flow backward out of the water supply connector 800*d* through the plurality of hot water inflow nozzles. The wash water flowing backward out of the water supply connector 800*d* through the plurality of hot water inflow nozzles may cause leakage of water in the washing machine 1. In order to prevent the backflow of wash water introduced into the water supply connector 800*d* through the plurality of hot water inflow nozzles or the plurality of cold water inflow nozzles as described above, the water supply connector 800*d* may include a backflow prevention structure disposed therein.

The backflow prevention structure may include a ball 2000 to open or close the plurality of inflow holes. Preferably, the backflow prevention structure may include a plurality of balls 2000 corresponding to the shape and the number of the plurality of inflow holes. The balls 2000 may open or close the plurality of inflow holes by a pressure of wash water introduced into the plurality of chambers 830 and 840. The balls 2000 may be accommodated in the plurality of chambers 830 and 840 to be adjacent to the plurality of inflow holes. The balls 2000 may be accommodated in the plurality of chambers 830 and 840 so as to be movable by a predetermined distance. The balls ball 2000 may be formed of an elastic material, e.g., rubber, urethane, and silicone.

The backflow prevention structure may further include a guide rib 2100 to guide movement of the balls 2000. Preferably, the backflow prevention structure may further include a pair of guide ribs 2100 to be spaced apart from each other at a predetermined interval. That is, the guide rib 2100 may be formed of two guide ribs facing each other at a predetermined interval. When the two guide ribs 2100 are used as described above, abnormal noise caused by the balls 2000 while wash water is supplied to the water supply connector 800*d* may be prevented. The guide ribs 2100 may be formed on the bottom surface of the connector housing 810. The guide ribs 2100 may be formed on the bottom surface of the connector housing 810 to be adjacent to the plurality of inflow holes. The guide ribs 2100 may be formed on the bottom surface of the connector housing 810 to protrude toward the inside of the plurality of chambers 830 and 840. The guide ribs 2100 may be integrated with the bottom surface of the connector housing 810 or separately formed from the bottom surface of the connector housing 810. The guide ribs 2100 will be described in more detail later.

The backflow prevention structure may further include a restraining rib 2200 configured to restrain movement of the ball 2000. The restraining rib 2200 may be provided in at least one of the connector housing 810 and the connector cover 820 to restrain movement of the ball 200 by more than a predetermined degree. The restraining rib 2200 may be provided in at least one of the connector housing 810 and the connector cover 820 to protruded toward the inside of the plurality of chambers 830 and 840. Preferably, the backflow prevention structure may include a plurality of restraining ribs 2200. Specifically, the plurality of restraining ribs 2200 may include a first restraining rib 2211 formed in the connector cover 820. The plurality of restraining ribs 2200 may further include a second restraining rib 2222 formed in the connector housing 810. The second restraining rib 2222 may include a right restraining rib and a left restraining rib facing each other with the guide rib 2100 interposed therebetween. The restraining rib 2200 will be described in more detail later.

The backflow prevention structure may further include a ball accommodating space 2300. The ball accommodating space 2300 may be formed in the plurality of chambers 830 and 840. The ball accommodating space 2300 may be defined by the guide rib 2100 and the restraining rib 2200. Specifically, the ball accommodating space 2300 may be defined by the guide rib 2100, the first restraining rib 2211, and the second restraining rib 2222. The ball accommodating space 2300 may be formed in the plurality of chambers 830 and 840 to be adjacent to the plurality of inflow holes. The ball 2000 may be accommodated in the ball accommodating space 2300 so as to be movable by a predetermined distance.

Figure 16:
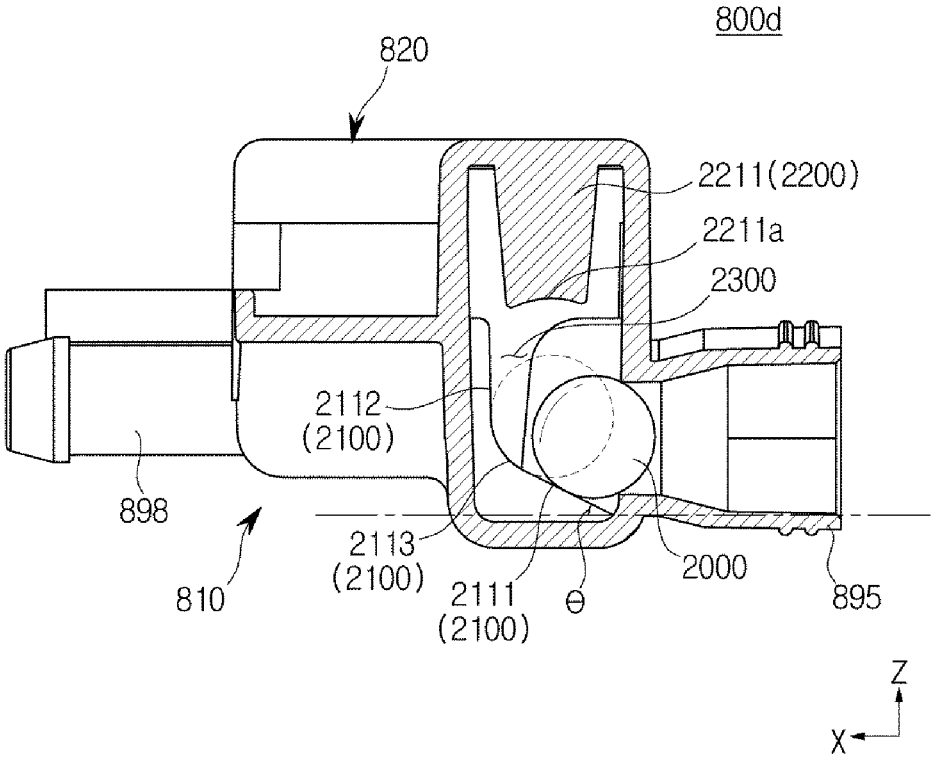
FIG. 16 is a cross-sectional view of the water supply connector of FIG. 14 taken along line A-A'.
Figure 17:
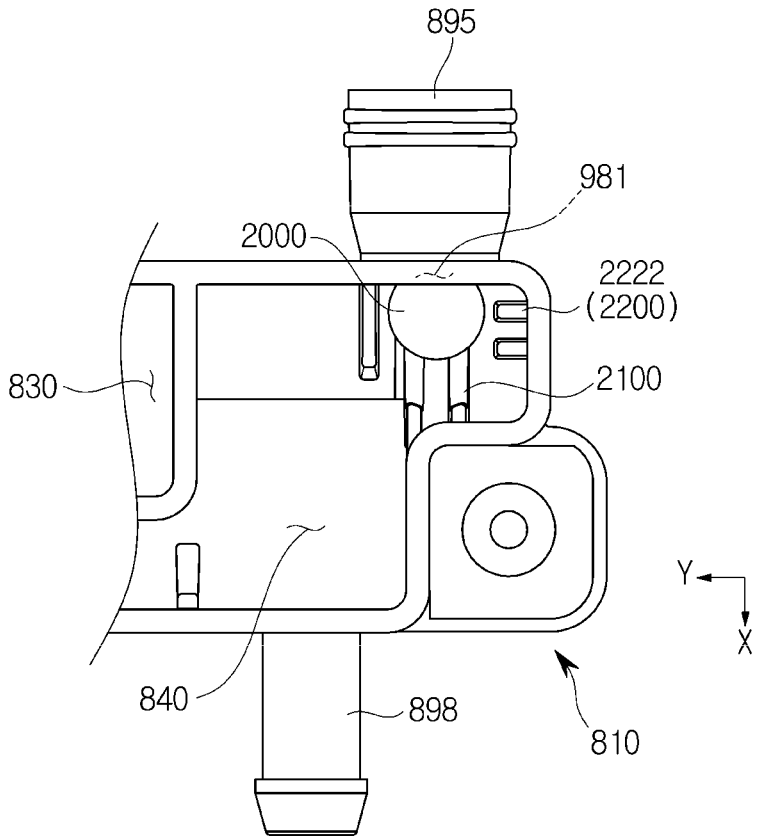
FIG. 17 is an enlarged view of a part of the water supply connector of a washing machine according to the fifth exemplary embodiment.

FIG. 16 is a cross-sectional view of the water supply connector of FIG. 14 taken along line A-A. FIG. 17 is an enlarged view of a part of the water supply connector of a washing machine according to the fifth exemplary embodiment. In FIG. 17, the connector cover 820 is omitted.

As illustrated in FIGS. 16 and 17, the guide rib 2100 may have a curved surface. Also, the guide rib 2100 may be formed to be inclined.

The guide rib 2100 may include a first section 2111, a second section 2112, and a connecting section 2113 connecting the first section 2111 and the second section 2112.

The first section 2111 may extend in the wash water inflow direction X with respect to the water supply connector 800*d*. The first section 2111 may be formed to be inclined. In other words, the first section 2111 may be formed to have a slope. The first section 2111 may be inclined upward in the wash water inflow direction X with respect to the water supply connector 800*d*. Preferably, the first section 2111 may be inclined upward to have a slope of 0 to 60° with the wash water inflow direction X with respect to the water supply connector 800*d*. That ball 2000 may move along the first section 2111.

The second section 2112 may extend in the lengthwise direction Z of the water supply connector 800*d*. The second section 2112 may restrict movement of the ball 2000 in the wash water inflow direction X with respect to the water supply connector 800*d* by a predetermined distance.

The connecting section 2113 may be disposed between the first section 2111 and the second section 2112. The connecting section 2113 may be formed in a curved surface. Preferably, the connecting section 2113 may have a curvature equal to that of the ball 2000. When the connecting section 2113 is designed to have the same curvature as that of the ball 2000, the ball 2000 moving toward the plurality of discharge nozzles may stably be seated in the connecting section 2113 by the pressure of the wash water.

The first restraining rib 2211 may be formed to extend in the lengthwise direction Z of the water supply connector 800*d* from the connector cover 820. The first restraining rib 2211 may have a ball facing surface 2211*a* that faces the ball 2000. The ball facing surface 2211*a* may face the bottom surface of the plurality of chambers 830 and 840. The ball facing surface 2211*a* may be formed in a curved surface. Preferably, the ball facing surface 2211*a* may have the same curvature as that of the ball 2000. However, the curvature of the ball facing surface 2211*a* is not limited thereto and may be modified in various manners.

The second restraining rib 2222 may be formed in the connector housing 810 to prevent the ball 2000 from moving in the widthwise direction Y of the water supply connector 800*d* by more than a predetermined distance. The second restraining rib 2222 may include right and left restraining ribs facing each other in the widthwise direction Y of the water supply connector 800*d*. At least one of the right and left restraining ribs may be configured as a pair. The shape of the second restraining rib 2222 is not limited thereto so long as the second restraining rib 2222 prevents the movement of the ball 200 in the widthwise direction Y of the water supply connector 800*d*.

Figure 18:
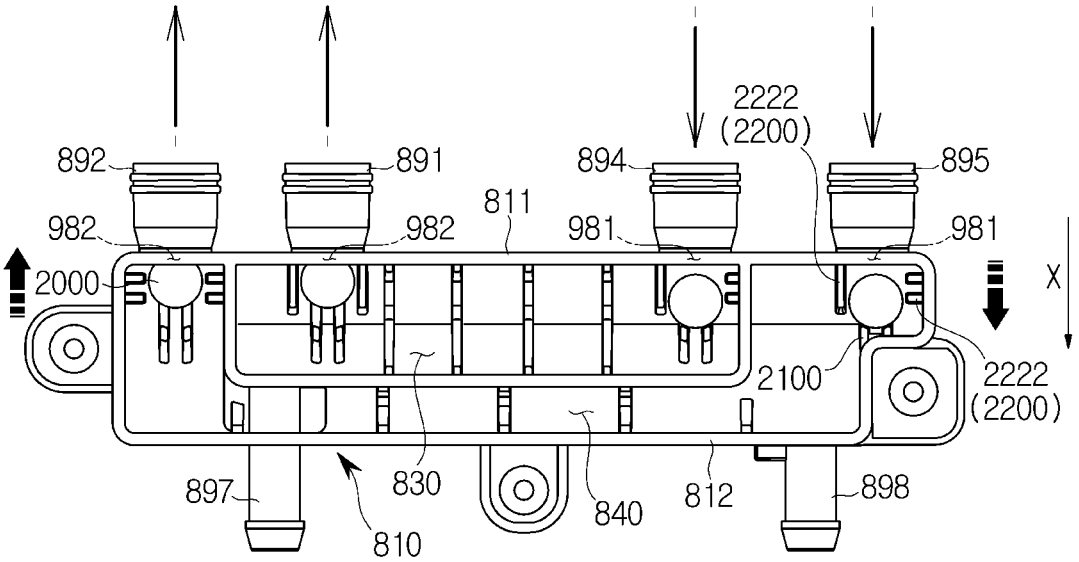
FIG. 18 is a view illustrating an operating state of a backflow prevention structure installed in a water supply connector of the washing machine according to the fifth exemplary embodiment.

FIG. 18 is a view illustrating an operating state of a backflow prevention structure installed in a water supply connector of the washing machine according to the fifth exemplary embodiment. In FIG. 18, thick arrows shown on the left and right sides indicate directions of water pressure applied to the balls 2000.

As illustrated in FIG. 18, the backflow prevention structure may operate by the pressure of wash water flowing into the plurality of chambers 830 and 840 through one of the plurality of hot water inflow nozzles and the plurality of cold water inflow nozzles. Hereinafter, an operating state of the backflow prevention structure will be described based on a case where cold water is introduced into the plurality of chambers 830 and 840 through the plurality of cold water inflow nozzles.

Normally, the ball 2000 is movable in the ball accommodating space 2300 by a predetermined distance. That is, the ball 2000 is in a state of freely moving by a predetermined distance in the ball accommodating space 2300 before cold water flows into the water supply connector 800*d*.

When cold water flows into the plurality of chambers 830 and 840 through the plurality of cold water inflow nozzles, a pressure of cold water flowing out of the plurality of cold water inflow nozzles is applied to the balls 2000 adjacent to the plurality of cold water inflow holes 981. Specifically, a pressure of cold water is applied to the balls 2000 adjacent to the plurality of cold water inflow holes 981 in the wash water inflow direction X with respect to the water supply connector 800*d*. As a result, the balls 2000 move away from the plurality of cold water inflow holes 981 along the guide rib 2100. That is, the balls 2000 may move along the first section 2111 of the guide rib guide rib 2100 until the movement of the balls 2000 is restricted by the second section 2112 of the guide rib 2100 to be seated at the connecting section 2113 of the guide rib 2100. In another aspect, when cold water flows into the water supply connector 800*d*, the pressure of cold water is applied to the balls 2000 adjacent to the plurality of cold water inflow holes 981 so that the plurality of cold water inflow holes 981 may be opened and cold water may flow into the plurality of chambers 830 and 840 through the plurality of cold water inflow holes 981. At least a part of cold water introduced into the plurality of chambers 830 and 840 may move toward the plurality of hot water inflow nozzles. In this case, a pressure is applied to the balls 2000 adjacent to the plurality of hot water inflow holes 982 in a direction opposite to the pressure applied to the balls 2000 adjacent to the plurality of cold water inflow holes 981. In other words, when cold water flows into the water supply connector 800*d*, a pressure of cold water is applied to the balls 2000 adjacent to the plurality of cold water inflow holes 981 in a direction toward the second wall 812 of the connector housing 810. On the contrary, a pressure is applied to the balls 2000 adjacent to the plurality of hot water inflow holes 982 in a direction toward the first wall 811 of the connector housing 810. As a result, the balls 2000 adjacent to the plurality of hot water inflow holes 982 move to be closer to the plurality of hot water inflow holes 982 and the plurality of hot water inflow holes 982 may be closed by the balls 2000. According to the backflow prevention structure, when only cold water is introduced into the plurality of chambers 830 and 840 through the plurality of cold water inflow nozzles, a backflow of cold water introduced into the plurality of chambers 830 and 840 through the plurality of hot water inflow nozzles may be efficiently prevented.

Although the backflow prevention structure applied to the water supply connector 800 according to the first exemplary embodiment has been described above with reference to FIGS. 14 to 18, the backflow prevention structure may also be applied to the water supply connectors 800*a*, 800*b*, and 800*c* according to the other embodiments as well as the water supply connector 800 according to the first exemplary embodiment.

As is apparent from the above description, wash water may be supplied to at least one of the first tub and the second tub by using one water supply device.

Since one of hot water and cold water may be supplied to each other the plurality of chambers, not only hot water and cold water but also warm water may be supplied to each other the plurality of washing spaces.

By using the water supply connector having the plurality of chambers, the water supply channel of wash water supplied to each of the plurality of washing space may be simplified.

By forming the backflow prevention structure in the water supply connector, wash water supplied through one of the plurality of hot water inflow nozzles and the plurality of cold water inflow nozzles may not flow backward through another nozzle among the plurality of hot water inflow nozzles and the plurality of cold water inflow nozzles.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A washing machine comprising:

a first housing having a first laundry loading port formed at a front portion thereof;

a first tub disposed in the first housing;

a second housing having a second laundry loading port formed at a top portion thereof and disposed above the first housing;

a second tub disposed in the second housing;

a water supply device installed in the second housing, and connectable to an external water source to supply water including cold water and hot water from the external water source to the first tub and the second tub, wherein the water supply device comprises:

a water supply connector having a plurality of chambers therein;

a first water supply hose to connect the water supply connector with the first tub;

a second water supply hose to connect the water supply connector with the second tub; and a backflow prevention structure formed in one of the plurality of the chambers to operate by a pressure of the water supplied to the plurality of chambers.

2. The washing machine according to claim 1, wherein the water supply connector further comprises:

a plurality of hot water inflow nozzles configured to supply the hot water from the external water source to the plurality of chambers; and a plurality of cold water inflow nozzles configured to supply the cold water from the external water source to the plurality of chambers, wherein in response to supplying the water through one of the plurality of hot water inflow nozzles and the plurality of cold water inflow nozzles, the backflow prevention structure prevents a backflow of the water into an other one of the plurality of hot water inflow nozzles and the plurality of cold water inflow nozzles.

3. The washing machine according to claim 2, wherein the water supply connector further comprises a plurality of inflow holes formed to communicate with the plurality of hot water inflow nozzles and the plurality of cold water inflow nozzles.

4. The washing machine according to claim 3, wherein the backflow prevention structure comprises a ball configured to open or close the plurality of inflow holes.

5. The washing machine according to claim 4, wherein the backflow prevention structure further comprises a guide rib configured to guide a movement of the ball.

6. The washing machine according to claim 4, wherein the backflow prevention structure further comprises a restriction rib configured to restrict a movement of the ball.

7. The washing machine according to claim 5, wherein the guide rib is formed to be inclined, and comprises a first section formed to extend in an inflow direction in which the water flows in with respect to the water supply connector, a second section formed to extend in a height direction of the water supply connector, and a connecting section disposed between the first section and the second section.

8. The washing machine according to claim 1, wherein the plurality of chambers comprises:

a first chamber; and a second chamber formed outside the first chamber along an outer periphery of the first chamber, and wherein the first chamber and the second chamber are separated from each other by a partition wall.

9. The washing machine according to claim 8, wherein the water supply connector comprises:

a first hot water inflow nozzle configured to supply hot water to the first chamber; and a first cold water inflow nozzle configured to supply cold water to the first chamber.

10. The washing machine according to claim 9, wherein the water supply connector further comprises a first wall, and the first hot water inflow nozzle and the first cold water inflow nozzle are protruding from the first wall of the water supply connector to be spaced apart from each other.

11. The washing machine according to claim 10, wherein the water supply connector further comprises a second wall facing the first wall, and a first discharge nozzle protruding from the second wall to discharge water out of the first chamber.

12. The washing machine according to claim 11, wherein the water supply connector further comprises a connection flow path connecting the first chamber with the first discharge nozzle, wherein the connection flow path is formed across the second chamber not to communicate with the second chamber.

13. The washing machine according to claim 11, wherein the water supply connector further comprises a second discharge nozzle protruding from the second wall of the water supply connector to discharge water out of the second chamber.

14. The washing machine according to claim 9, wherein the water supply connector further comprises:

a second hot water inflow nozzle configured to supply hot water to the second chamber; and a second cold water inflow nozzle configured to supply cold water to the second chamber.

15. The washing machine according to claim 14, wherein the second hot water inflow nozzle and the second cold water inflow nozzle are protruding from the first wall of the water supply connector to be spaced apart from each other.

* * * * *